US010865665B2

(12) United States Patent
Schmitt et al.

(10) Patent No.: US 10,865,665 B2
(45) Date of Patent: Dec. 15, 2020

(54) CAM PHASING SYSTEMS AND METHODS

(71) Applicant: HUSCO Automotive Holdings LLC, Waukesha, WI (US)

(72) Inventors: Austin Schmitt, Hartland, WI (US); Allen Tewes, Spirit Lake, IA (US); Michael Kujak, Delafield, WI (US); Brian Heidemann, Lake Mills, WI (US)

(73) Assignee: HUSCO Automotive Holdings LLC, Waukesha, WI (US)

( * ) Notice: Subject to any disclaimer, the term of this patent is extended or adjusted under 35 U.S.C. 154(b) by 0 days.

(21) Appl. No.: 16/784,085

(22) Filed: Feb. 6, 2020

(65) Prior Publication Data

US 2020/0173316 A1 Jun. 4, 2020

Related U.S. Application Data

(63) Continuation of application No. 15/876,806, filed on Jan. 22, 2018, now Pat. No. 10,557,383.

(60) Provisional application No. 62/449,096, filed on Jan. 22, 2017, provisional application No. 62/449,098, filed on Jan. 22, 2017, provisional application No. 62/448,611, filed on Jan. 20, 2017.

(51) Int. Cl.
*F01L 1/344* (2006.01)
*F01L 1/02* (2006.01)

(52) U.S. Cl.
CPC ..... *F01L 1/34403* (2013.01); *F01L 1/02* (2013.01); *F01L 1/34406* (2013.01); *F01L 2001/34453* (2013.01); *F01L 2001/34483* (2013.01); *F01L 2250/02* (2013.01); *F01L 2250/04* (2013.01); *F01L 2250/06* (2013.01)

(58) Field of Classification Search
CPC ..... F01L 1/34403; F01L 1/34406; F01L 1/46
USPC ..... 123/90.17
See application file for complete search history.

(56) References Cited

U.S. PATENT DOCUMENTS 4,986,801 A * 1/1991 Ohlendorf ..... F01L 1/34406 123/90.17
5,125,372 A * 6/1992 Gondek ..... F01L 1/08 123/90.12
5,588,404 A * 12/1996 Lichti ..... F01L 1/34406 123/90.17

* cited by examiner

*Primary Examiner* — Jorge L Leon, Jr.
(74) *Attorney, Agent, or Firm* — Quades & Brady LLP

(57) ABSTRACT

Cam phasing systems and methods are provided. In particular, a cam phasing system is provided that includes a reduced number of components when compared to current mechanical cam phasing systems. The cam phasing system includes a helix locking design that is configured to frictionally lock an helix rod during cam torque pulses.

20 Claims, 25 Drawing Sheets

CAM PHASING SYSTEMS AND METHODS

CROSS-REFERENCES TO RELATED APPLICATIONS

The present application is a continuation of U.S. patent application Ser. No. 15/876,806, filed on Jan. 22, 2018, which is based on and claims priority to U.S. Provisional Patent Application No. 62/448,611, filed on Jan. 20, 2017, U.S. Provisional Patent Application No. 62/449,096, filed on Jan. 22, 2017, and U.S. Provisional Patent Application No. 62/449,098, filed on Jan. 22, 2017, each of which is incorporated herein by reference in its entirety.

STATEMENT REGARDING FEDERALLY SPONSORED RESEARCH

Not Applicable.

BACKGROUND

Currently, cam phasing systems can include a rotary actuator, or phaser, that may be configured to rotate a cam shaft relative to a crank shaft of an internal combustion engine. Currently, phasers can be hydraulically actuated, electronically actuated, or mechanically actuated. Typically, mechanically actuated phasers harvest cam torque pulses to enable the rotation of the phaser. This operation only allows the phaser to rotate in the direction of the cam torque pulse. Additionally, a speed of the rotation of the phaser and a stop position of the phaser after the cam torque pulse has ended, are functions of a magnitude/direction of the cam torque pulses and a speed of the engine, among other things. Thus, the speed of the phaser rotation and stop position cannot be controlled directly by such mechanical cam phasing systems. Since the cam torque pulses can be large relative to the dampening of the mechanical cam phasing system, the phaser can easily overshoot or undershoot the desired rotation amount, which can result in the mechanical cam phasing system continuously being cycled on and off, or requiring very fast control.

SUMMARY OF THE INVENTION

The present disclosure relates generally to cam phasing on an internal combustion engine and, more specifically, to a cam phasing system with a helix locking design and associated methods. In some non-limiting examples, a cam phasing system is provided that includes a reduced number of components when compared to current mechanical cam phasing systems. The cam phasing system includes a helix design that is configured to frictionally lock an input component during cam torque pulses or transfer cam torque pulses into smaller axial forces.

In some aspects, the present disclosure provides a cam phasing system configured to vary a rotational relationship between a camshaft and a crankshaft on an internal combustion engine. The cam phasing system includes a crank coupling component configured to be coupled to the crankshaft, and a cam coupling component configured to be coupled to the crankshaft. The cam coupling component includes a first helical feature. The cam phasing system further includes an input component including a second helical feature. The second helical feature is configured to interact with the first helical feature to vary a rotational relationship between the camshaft and the crankshaft. The interaction between the first helical feature and the second helical feature is configured to frictionally lock the cam coupling component to the input component during rotary torque events.

In some aspects of the present disclosure, an actuator is coupled to an input component.

In some aspects of the present disclosure, actuator is configured to apply an input force on an input component.

In some aspects of the present disclosure, a compliance mechanism is coupled between an input component and an actuator.

In some aspects of the present disclosure, a compliance mechanism is configured to transfer an input force from an actuator to the input component to ensure that a cam coupling component reaches a desired rotational position relative to a crank coupling component.

In some aspects, the present disclosure provides a cam phasing system configured to vary a rotational relationship between a camshaft and a crankshaft on an internal combustion engine. The cam phasing system includes a sprocket hub configured to be coupled to the crankshaft, and a cradle rotor configured to be coupled to the camshaft. The cradle rotor includes a helical feature. The cam phasing system further includes a helix rod including a spline having a helical portion configured to interact with the helical feature of the cradle rotor to vary a rotational relationship between the camshaft and the crankshaft. The interaction between the helical feature and the helical portion is configured to frictionally lock the cradle rotor to the helix rod during rotary torque events.

In some aspects of the present disclosure, an actuator is coupled to a helix rod.

In some aspects of the present disclosure, an actuator is configured to apply an input force on a helix rod.

In some aspects of the present disclosure, a compliance mechanism is coupled between a helix rod and an actuator.

In some aspects of the present disclosure, a compliance mechanism is configured to transfer an input force from the actuator to a helix rod to ensure that a cradle rotor reaches a desired rotational position relative to a sprocket hub.

In some aspects of the present disclosure, a helical feature defines a helix angle that is greater than approximately 50 degrees.

In some aspects of the present disclosure, a helical feature defines a helix angle that is greater than approximately 60 degrees.

In some aspects of the present disclosure, an end plate is coupled to a sprocket hub.

In some aspects, an end plate includes a central aperture having a protrusion configured to engage a helix rod and inhibit the helix rod from rotating relative to an end plate.

In some aspects of the present disclosure, a cradle rotor includes a plurality of helical features arranged circumferentially around an inner bore thereof.

In some aspects of the present disclosure, a plurality of helical features each define a radial recess in an inner bore that defines a helical profile as the plurality of helical features extend axially along the inner bore.

In some aspects of the present disclosure, a helix rod includes a plurality of splines arranged circumferentially thereon each including an helical portion and an axial portion.

In some aspects of the present disclosure, a cradle rotor is configured to be rotated relative to a sprocket hub in a rotational range between 0 degrees and 360 degrees.

In some aspects of the present disclosure, a cradle rotor is configured to be received within an inner bore of a sprocket hub.

In some aspects of the present disclosure, a cradle rotor is inhibited from displacing axially relative to a sprocket hub.

In some aspects, the present disclosure provides a cam phasing system configured to vary a rotational relationship between a camshaft and a crankshaft on an internal combustion engine. The cam phasing system includes a crank coupling component configured to be coupled to the crankshaft, and a cam coupling component configured to be coupled to the camshaft. The cam coupling component includes a first helical feature. The cam phasing system further includes an input component including a second helical feature. The second helical feature is configured to interact with the first helical feature to vary a rotational relationship between the camshaft and the crankshaft. The interaction between the first helical feature and the second helical feature is configured to transfer rotary torque from the cam coupling component to axial force on the input component that is selectively supported by an external force.

In some aspects of the present disclosure, an external force is provided by a linear clutch.

In some aspects of the present disclosure, a push-pull coupling is arranged between a linear clutch and an input component.

In some aspects of the present disclosure, a push-pull coupling comprises a self-aligning bearing configured to accommodate angular misalignment between a linear clutch and an input component.

In some aspects of the present disclosure, a push-pull coupling includes a first bearing configured to be coupled to the an component, a second bearing configured to be coupled to a linear clutch, and the first bearing and the second bearing are inhibited from displacing axially with respect to one another and rotational motion is allowed between the first bearing and the second bearing.

In some aspects of the present disclosure, a push-pull coupling includes a coupling head having a plurality of radially flexible arms to facilitate coupling to a linear clutch, a housing configured to be coupled to an input component, and a bearing assembly having a bearing and an inner housing, the coupling head is coupled to the bearing and the coupling head is prevented from rotating with the housing and the input component.

In some aspects of the present disclosure, a linear clutch includes a locking assembly having a first locking member and a second locking member, wherein each of the first locking member and the second locking member are moveable between a locked state and an unlocked state.

In some aspects of the present disclosure, when a first locking assembly is in a locked state, an input component is prevented from translating axially in a first direction, and when the first locking assembly is in an unlocked state, the input component is allowed to displace axially in the first direction.

In some aspects of the present disclosure, when a second locking assembly is in a locked state, an input component is prevented from translating axially in a second direction opposite to a first direction, and when the second locking assembly is in the unlocked state, the input component is allowed to displace axially in the second direction.

In some aspects of the present disclosure, in a free state with no axial input force applied to an input component, a first locking assembly and a second locking assembly are in a locked state and prevent a rotary torque acting on a cam coupling component from axially translating the input component.

In some aspects of the present disclosure, a locking assembly is arranged externally from a crank coupling component.

In some aspects of the present disclosure, a locking assembly is arranged internally within a crank coupling component.

In some aspects of the present disclosure, a compliance mechanism is coupled between a linear clutch and an actuator.

In some aspects of the present disclosure, a compliance mechanism is configured to transfer an input force from an actuator to a linear clutch to ensure that a cam coupling component reaches a desired rotational position relative to a crank coupling component.

In some aspects of the present disclosure, a compliance mechanism is arranged externally from a crank coupling component.

In some aspects of the present disclosure, a compliance mechanism is arranged internally within a crank coupling component.

In some aspects, the present disclosure provides, a cam phasing system configured to vary a rotational relationship between a camshaft and a crankshaft on an internal combustion engine. The cam phasing system includes a sprocket hub configured to be coupled to the crankshaft, and a cradle rotor configured to be coupled to the camshaft. The cradle rotor includes a helical feature. The cam phasing system further includes a helix rod having a spline with a helical portion configured to interact with the helical feature of the cradle rotor to vary a rotational relationship between the camshaft and the crankshaft. The interaction between the first helical feature and the helical portion is configured to transfer rotary torque from the cradle rotor to axial force on the helix rod that is selectively supported by an external force.

In some aspects of the present disclosure, an external force is provided by a linear clutch.

In some aspects of the present disclosure, a push-pull coupling is arranged between a linear clutch and an helix rod.

In some aspects of the present disclosure, a push-pull coupling comprises a self-aligning bearing configured to accommodate angular misalignment between a linear clutch and an helix rod.

In some aspects of the present disclosure, a push-pull coupling includes a first bearing configured to be coupled to the an component, a second bearing configured to be coupled to a linear clutch, and the first bearing and the second bearing are inhibited from displacing axially with respect to one another and rotational motion is allowed between the first bearing and the second bearing.

In some aspects of the present disclosure, a push-pull coupling includes a coupling head having a plurality of radially flexible arms to facilitate coupling to a linear clutch, a housing configured to be coupled to an helix rod, and a bearing assembly having a bearing and an inner housing, the coupling head is coupled to the bearing and the coupling head is prevented from rotating with the housing and the helix rod.

In some aspects of the present disclosure, a linear clutch includes a locking assembly having a first locking member and a second locking member, wherein each of the first locking member and the second locking member are moveable between a locked state and an unlocked state.

In some aspects of the present disclosure, when a first locking assembly is in a locked state, an helix rod is prevented from translating axially in a first direction, and when the first locking assembly is in an unlocked state, the helix rod is allowed to displace axially in the first direction.

In some aspects of the present disclosure, when a second locking assembly is in a locked state, an helix rod is prevented from translating axially in a second direction opposite to a first direction, and when the second locking assembly is in the unlocked state, the helix rod is allowed to displace axially in the second direction.

In some aspects of the present disclosure, in a free state with no axial input force applied to a helix rod, a first locking assembly and a second locking assembly are in a locked state and prevent a rotary torque acting on a cam coupling component from axially translating the helix rod.

In some aspects of the present disclosure, a locking assembly is arranged externally from a crank coupling component.

In some aspects of the present disclosure, a locking assembly is arranged internally within a crank coupling component.

In some aspects of the present disclosure, a compliance mechanism is coupled between a linear clutch and an actuator.

In some aspects of the present disclosure, a compliance mechanism is configured to transfer an input force from an actuator to a linear clutch to ensure that a cam coupling component reaches a desired rotational position relative to a crank coupling component.

In some aspects of the present disclosure, a compliance mechanism is arranged externally from a crank coupling component.

In some aspects of the present disclosure, a compliance mechanism is arranged internally within a crank coupling component.

In some aspects, the present disclosure provides a cam phasing system configured to vary a rotational relationship between a camshaft and a crankshaft on an internal combustion engine. The cam phasing system includes a sprocket hub configured to be coupled to the crankshaft, and a cradle rotor configured to be coupled to the camshaft. The cam coupling component includes a first helical feature. The cam phasing system further includes a helix rotor having a second helical feature. The second helical feature is configured to interact with the first helical feature to vary a rotational relationship between the camshaft and the crankshaft. The cam phasing system further includes a linear clutch having an input component configured to receive an input force and a locking assembly configured to selectively restrict or enable relative motion between the cradle rotor and the sprocket hub.

In some aspects, the present disclosure provides a cam phasing system configured to vary a rotational relationship between a camshaft and a crankshaft on an internal combustion engine. The cam phasing system includes at least two helix sections. Each helix section includes a crank coupling tube having a crank helical protrusion, a cam coupling tube having a cam helical protrusion, a first input ring having a first helical recess, and a second input ring having a second helical recess. The crank helical protrusion is received within the first helical recess, and the cam helical protrusion is received within the second helical recess. The first input ring and the second input ring are alternatingly stacked axially and configured to displace axially relative to the crank coupling tube and the cam coupling tube. When the first and second input rings are displaced axially, the cam coupling tubes are rotated relative to the crank coupling tubes.

In some aspects of the present disclosure, an interaction between a crank helical protrusion and a first helical recess and an interaction between a cam helical protrusion and a second helical recess is configured to frictionally lock crank coupling tubes relative to cam coupling tubes during rotary torque events.

In some aspects, the present disclosure provides a compliance mechanism configured to be coupled between a first component and a second component. The first component is configured to provide an input force to move the second component in either a first direction or a second direction to a desired position, and the second component is subjected to external forces in either the first direction or the second direction. The compliance mechanism includes a first part configured to be coupled to the first component, a second part configured to be coupled to the second component, and a spring coupled between the first part and the second part. The spring is configured to provide forces relative to the input force from the first component to the second component to ensure the second component reaches the desired position regardless of the direction, magnitude, and timing of the external forces.

In some aspects of the present disclosure, a first part is a housing including an inner bore.

In some aspects of the present disclosure, a second part is slidably received within an inner bore.

In some aspects of the present disclosure, an inner bore defines an actuation chamber, a spring chamber, and a threaded bore.

In some aspects of the present disclosure, a housing includes a coupling aperture configured to enable a first component to be coupled thereto.

In some aspects of the present disclosure, a housing includes a relief port configured to provide fluid communication between an actuation chamber and the surroundings external from a housing.

In some aspects of the present disclosure, a biasing element is configured to provide a preload on a first part and a second part.

In some aspects of the present disclosure, a push-pull coupling includes a first washer and a second washer.

In some aspects of the present disclosure, a biasing element is arranged between a first washer and a second washer.

In some aspects of the present disclosure, a biasing element is configured to provide a preload on a first washer and a second washer to bias the first washer and the second washer away from one another.

In some aspects of the present disclosure, a first washer is biased against a flange on a first part.

In some aspects of the present disclosure, a second washer is biased against a first end of a second part.

In some aspects, the present disclosure provides a compliance mechanism configured to be coupled between a first component and a second component. The first component is configured to provide an input force to move the second component in either a first direction or a second direction to a desired position. The second component is subjected to external forces in either the first direction or the second direction. The compliance mechanism includes a housing configured to be coupled to the first component, a part configured to be coupled to the second component, and a biasing element coupled between the housing and the part. A first relative relationship is defined between the housing and the part, and the biasing element is configured to provide a biasing force that ensures that the first relative relationship is maintained between the housing and the part.

In some aspects, the present disclosure provides, a compliance mechanism configured to be coupled between a first component and a second component. The first component is configured to provide an input force to move the second component in either a first direction or a second direction to a desired position. The compliance mechanism includes a coil portion configured to be coupled to the second component, a first end extending from the coil portion and coupled to the first component, and a second end extending from the coil portion and coupled to the first component. The input force provided to the first component biases the first end of the second end to create a biasing force that ensures that the move coil portion and thereby the second component reaches the desired position regardless of the direction, magnitude, and timing of the external forces.

In some aspects, the present invention provides a push-pull coupling including a housing defining an inner bore, a first bearing configured to be received within a first end of the inner bore, and a second bearing configured to be received within a second end of the inner bore.

In some aspects of the present disclosure, a push-pull coupling includes a housing defining an inner bore.

In some aspects of the present disclosure, a housing defines a generally cylindrical shape.

In some aspects of the present disclosure, a first bearing is configured to be received within a first end of an inner bore and a second bearing is configured to be received within a second end of the inner bore.

In some aspects of the present disclosure, a first bearing and a second bearing are press-fit into an inner bore.

In some aspects of the present disclosure, a first bearing and a second bearing are self-aligning bearings.

In some aspects of the present disclosure, a first bearing includes a first coupling aperture and a second bearing includes a second coupling aperture.

In some aspects of the present disclosure, a first coupling aperture is configured to couple a first bearing to a first component, and a second coupling aperture is configured to couple a second bearing to a second component.

In some aspects of the present disclosure, a first component is a rotating component.

In some aspects of the present disclosure, a second component is a non-rotating component.

In some aspects of the present disclosure, a second component is a rotating component.

In some aspects of the present disclosure, first and second bearings are configured to accommodate an radial offset between a first component and a second component.

In some aspects of the present disclosure, first and second bearings are configured to accommodate an angular offset between a first component and a second component.

In some aspects of the present disclosure, a shaft is configured to connect the first bearing and the second bearing.

In some aspects of the present disclosure, a first bearing includes a first coupling aperture and a second bearing includes a second coupling aperture.

In some aspects of the present disclosure, a shaft is dimensioned to be received within a first coupling aperture and a second coupling aperture.

The foregoing and other aspects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims and herein for interpreting the scope of the invention.

DESCRIPTION OF DRAWINGS

The invention will be better understood and features, aspects and advantages other than those set forth above will become apparent when consideration is given to the following detailed description thereof. Such detailed description makes reference to the following drawings

DETAILED DESCRIPTION OF THE INVENTION

Figure 1:
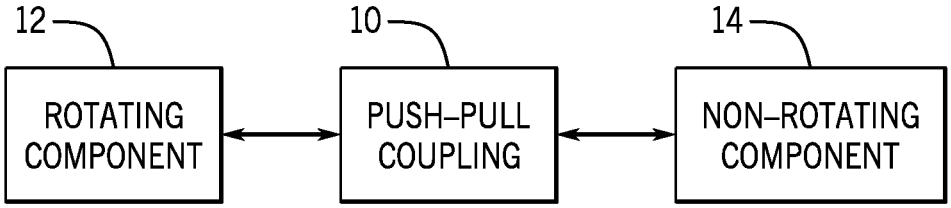
FIG. 1 is a schematic of a push-pull coupling arranged between a rotating component and a non-rotating component according to one aspect of the present disclosure.

Before any aspect of the present disclosure are explained in detail, it is to be understood that the present disclosure is not limited in its application to the details of construction and the arrangement of components set forth in the following description or illustrated in the following drawings. The present disclosure is capable of other configurations and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use aspects of the present disclosure. Various modifications to the illustrated configurations will be readily apparent to those skilled in the art, and the generic principles herein can be applied to other configurations and applications without departing from aspects of the present disclosure. Thus, aspects of the present disclosure are not intended to be limited to configurations shown, but are to be accorded the widest scope consistent with the principles and features disclosed herein. The following detailed description is to be read with reference to the figures, in which like elements in different figures have like reference numerals. The figures, which are not necessarily to scale, depict selected configurations and are not intended to limit the scope of the present disclosure. Skilled artisans will recognize the non-limiting examples provided herein have many useful alternatives and fall within the scope of the present disclosure.

In some mechanical systems, a connection mechanism may be needed to attach a rotational component to either a non-rotational component or another rotational component. One non-limiting example of such a mechanical system is a cam phasing application. In cam phasing applications, the goal is to selectively alter the phase (i.e., a rotational relationship between) a camshaft and a crankshaft on, for example, an internal combustion engine. This may be achieved via a variety of actuation methods. For example, various cam phasing systems and methods that may be applicable to the present disclosure are described in U.S. patent application Ser. No. 15/216,352 ('352 patent), the entire contents of which are incorporated herein by reference.

In some cam phasing systems, axial motion (e.g., via a linear actuator) may be translated into rotational motion that alters the phase between the camshaft and the crankshaft. In these arrangements, an axial force is applied to provide linear motion and actuate the system. This may be advantageous because the actuation mechanism that applies the axial force is not required to rotate with the camshaft like the rest of the cam phasing system. However, in some other cam phasing systems, a rotational input force may be applied to alter the phase between the camshaft and the crankshaft.

In, for example, these cam phasing systems, a coupling mechanism may be required to attach the phaser, which rotates with the camshaft, to the actuation mechanism, which may or may not rotate. The present disclosure provides systems and methods for a push-pull coupling that may be arranged between a rotational component and a non-rotational or another rotational component.

FIG. 1 illustrates one non-limiting application of a push-pull coupling 10 according to the present disclosure. As shown in FIG. 1, the push-pull coupling 10 may be coupled between a rotating component 12 and a non-rotating component 14. The push-pull coupling 10 is configured to allow high speed rotational freedom between the rotating component 12 and the non-rotating component 14. That is, the push-pull coupling 10 enables the rotating component 12 to rotate with respect to the non-rotating component 14 without imparting the rotational motion to the non-rotating component 14. The push-pull coupling 10 is further configured to prevent relative axial motion between the rotating component 12 and the non-rotating component 14. That is, the push-pull coupling 10 is configured to transfer axial motion from the non-rotating component 14 directly to the rotating component 12 without any relative axial motion therebetween.

The push-pull coupling 10 may allow for misalignment between the rotating component 12 and the non-rotating component 14. In some non-limiting example, the push-pull coupling 10 may be configured to compensate for axial and/or angular misalignment between the rotating component 12 and the non-rotating component 14. That is, the rotating component 12 and the non-rotating component 14 may be axially or angularly misaligned and the push-pull coupling 10 may still facilitate the coupling therebetween and the operation thereof.

Figure 2:
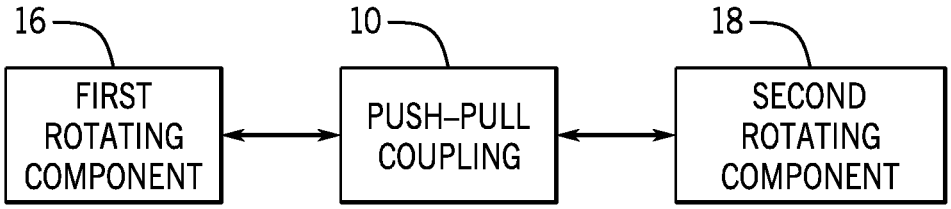
FIG. 2 is a schematic of a push-pull coupling arranged between two rotating components according to one aspect of the present disclosure.

FIG. 2 illustrates another application of the push-pull coupling 10 according to the present disclosure. As shown in FIG. 2, the push-pull coupling 10 may be coupled between a first rotating component 16 and a second rotating component 18. The functionality and advantages of the push-pull coupling 10 described above with reference to FIG. 1 also apply to the configuration of FIG. 2.

Figure 3:
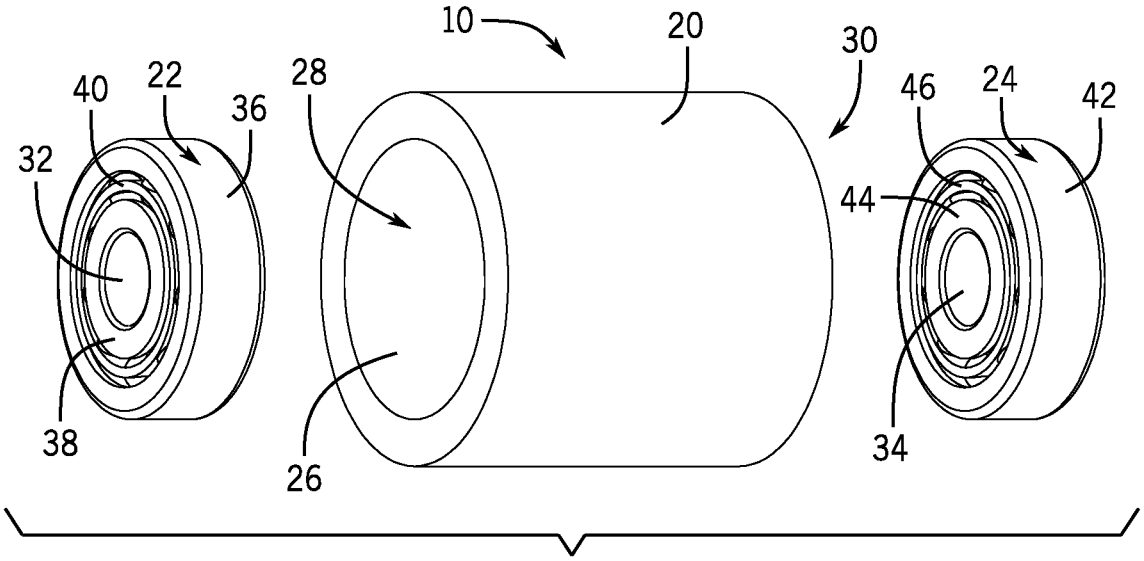
FIG. 3 is an exploded left, top, back isometric view of a push-pull coupling according to one aspect of the present disclosure.
Figure 4:
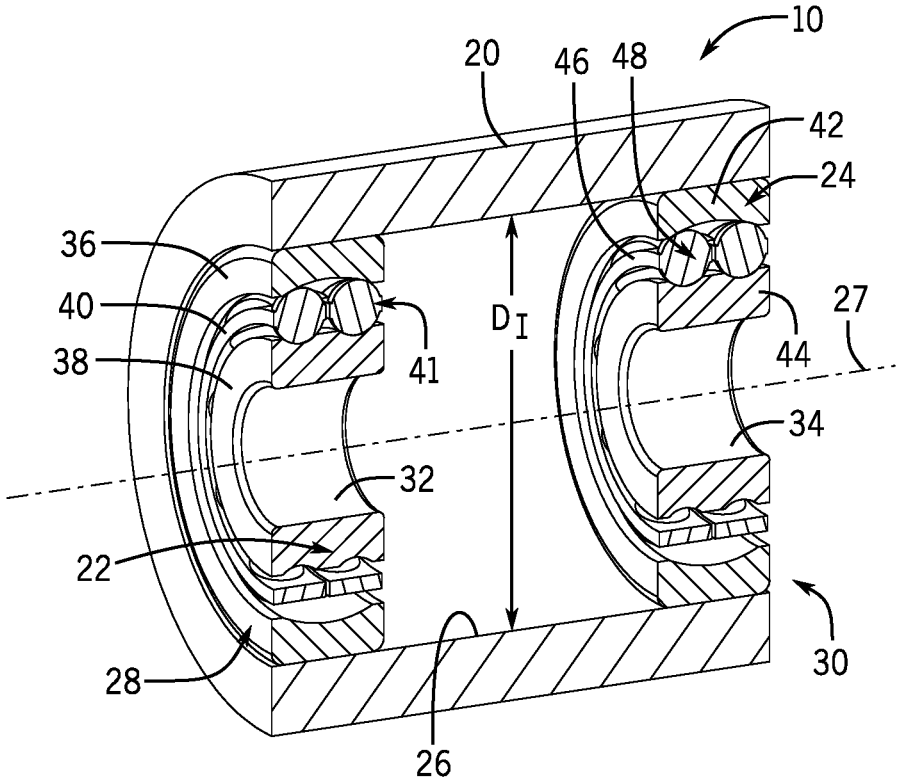
FIG. 4 is a cross-sectional view of the push-pull coupling of FIG. 3 in an assembled state.

FIGS. 3 and 4 illustrate one non-limiting example of the push-pull coupling 10 according to the present disclosure.

The push-pull coupling 10 includes a housing 20, a first bearing 22, and a second bearing 24. The housing 20 defines a generally cylindrical shape having an inner bore 26. The inner bore 26 defines a center axis 27 and a diameter Di that is dimensioned to receive the first bearing 22 and the second bearing 24.

The first bearing 22 is configured to be received within a first end 28 of the inner bore 26, and the second bearing 24 is configured to be received within a second end 30 of the inner bore 26 opposite the first end 28. In some non-limiting examples, to assemble the push-pull coupling 10, the first bearing 22 may be press-fit into the first end 28 of the inner bore 26 and the second bearing 24 may be press-fit into the second end 30 of the inner bore 26. The press-fit between the first and second bearings 22 and 24 may be facilitated by the diameter Di of the inner bore 26 being sized to ensure that the first and second bearings 22 and 24 may be frictionally secured within the inner bore 26. In other non-limiting examples, another securing mechanism may be utilized to secure the first and second bearings 22 and 24 within the housing 20 (e.g., a keyed feature, a stepped diameter in the inner bore 26, a pin, etc.).

The first bearing 22 includes a first coupling aperture 32 and the second bearing 24 includes a second coupling aperture 34. In the non-limiting application of FIG. 1, the first coupling aperture 32 may be configured to couple the first bearing 22 to one of the rotating component 12 and the non-rotating component 14, and the second coupling aperture 34 may be configured to couple the second bearing 24 to the other of the rotating component 12 and the non-rotating component 14. In the non-limiting example of FIG. 2, the first coupling aperture 32 may be configured to couple the first bearing 22 to one of the first rotating component 16 and the second rotating component 18, and the second coupling aperture 34 may be configured to couple the second bearing 24 to the other of the first rotating component 16 and the second rotating component 18.

In some non-limiting examples, the first and second bearings 22 and 24 may be in the form of spherical roller bearings. In other non-limiting examples, the first and second bearings 22 and 24 may be in the form of spherical plain bearings, self-aligning bearings, self-aligning ball bearings, toroidal roller bearings, spherical roller thrust bearings, or other bearings that can handle misalignment. For example, as illustrated in FIGS. 4-7, the first bearing 22 may comprise a first outer ring 36, a first inner ring 38, and a first roller ring 40 arranged radially between the first outer ring 36 and the first inner ring 38. The outer diameter of the first outer ring 36 may be press-fit into the inner bore 26 and the first coupling aperture 32 may be formed by the inner diameter of the first inner ring 38. A first plurality of rollers 41 (e.g., spherical rollers or bearings) may be arranged circumferentially around and secured between the first outer ring 36 and the first inner ring 38 by the first roller ring 40. In operation, the first plurality of rollers 41 may enable the first inner ring 38 to move rotationally in any orientation relative to the first outer ring 36, which is secured to the housing 20. That is, the first inner ring 38 may be able to rotate three-dimensionally within the first outer ring 36 to compensate for various angular and/or axial misalignments between the components coupled by the push-pull coupling 10. Similar to the first bearing 22, the second bearing 24 may also include a second outer ring 42, a second inner ring 44, and a second roller ring 46 that secures a second plurality of rollers 48 between the second outer ring 42 and the second inner ring 44. The operation and arrangement of second bearing 24 may be similar to that of the first bearing 22 described above. For example, the second inner ring 44 may be able to rotate three-dimensionally within the second outer ring 42 to compensate for various angular and/or axial misalignments between the components coupled by the push-pull coupling 10.

Figure 5:
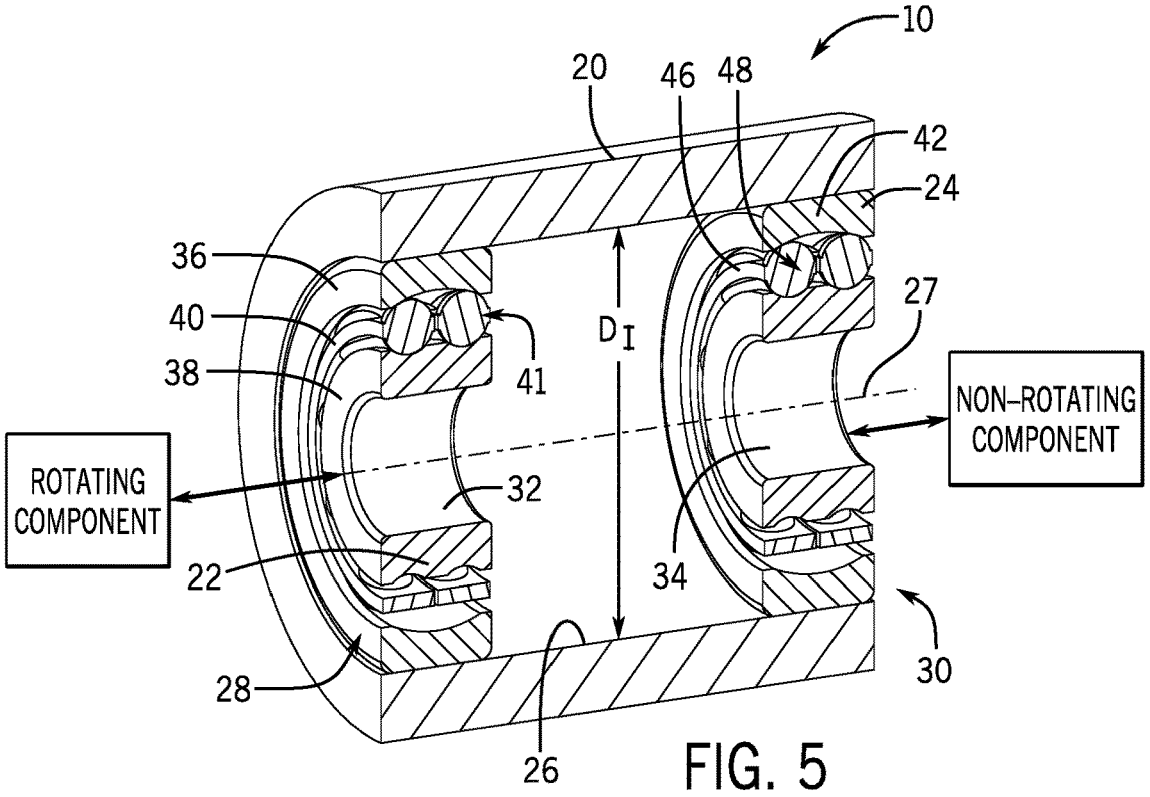
FIG. 5 is a schematic of the push-pull coupling of FIG. 3 coupled between a rotating component and a radially misaligned non-rotating component.
Figure 6:
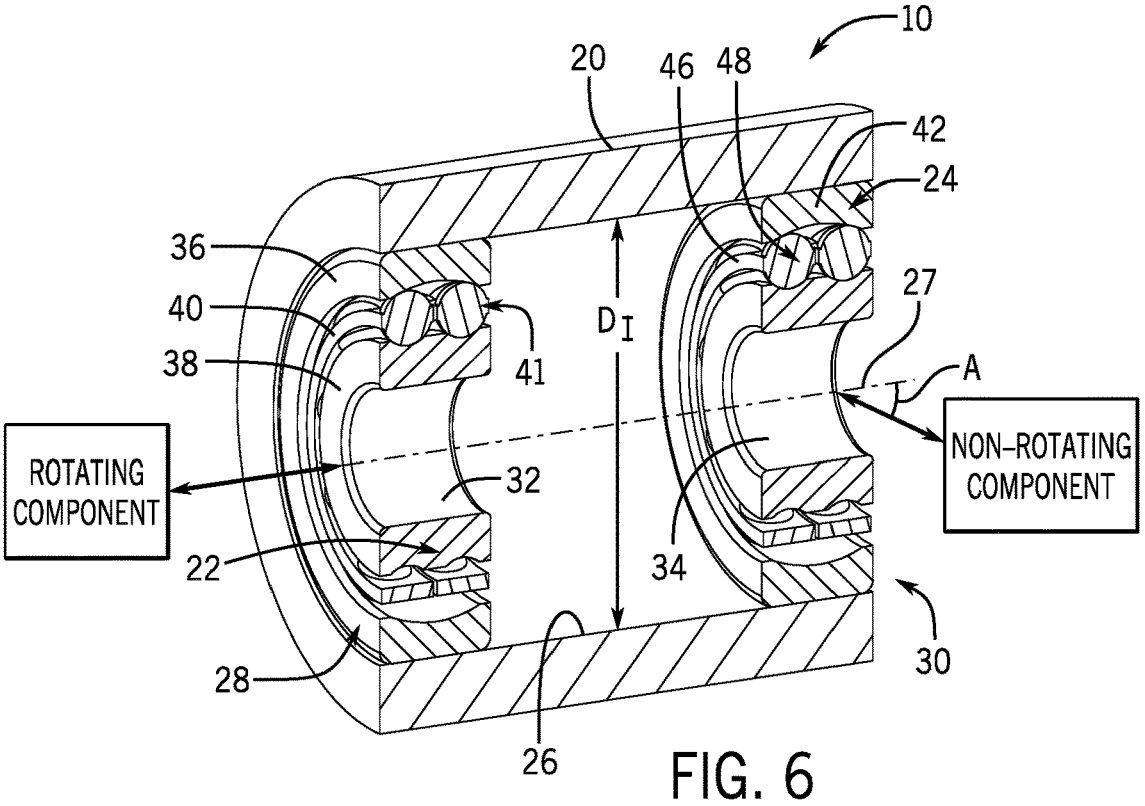
FIG. 6 is a schematic of the push-pull coupling of FIG. 3 coupled between a rotating component and an angularly misaligned non-rotating component.
Figure 7:
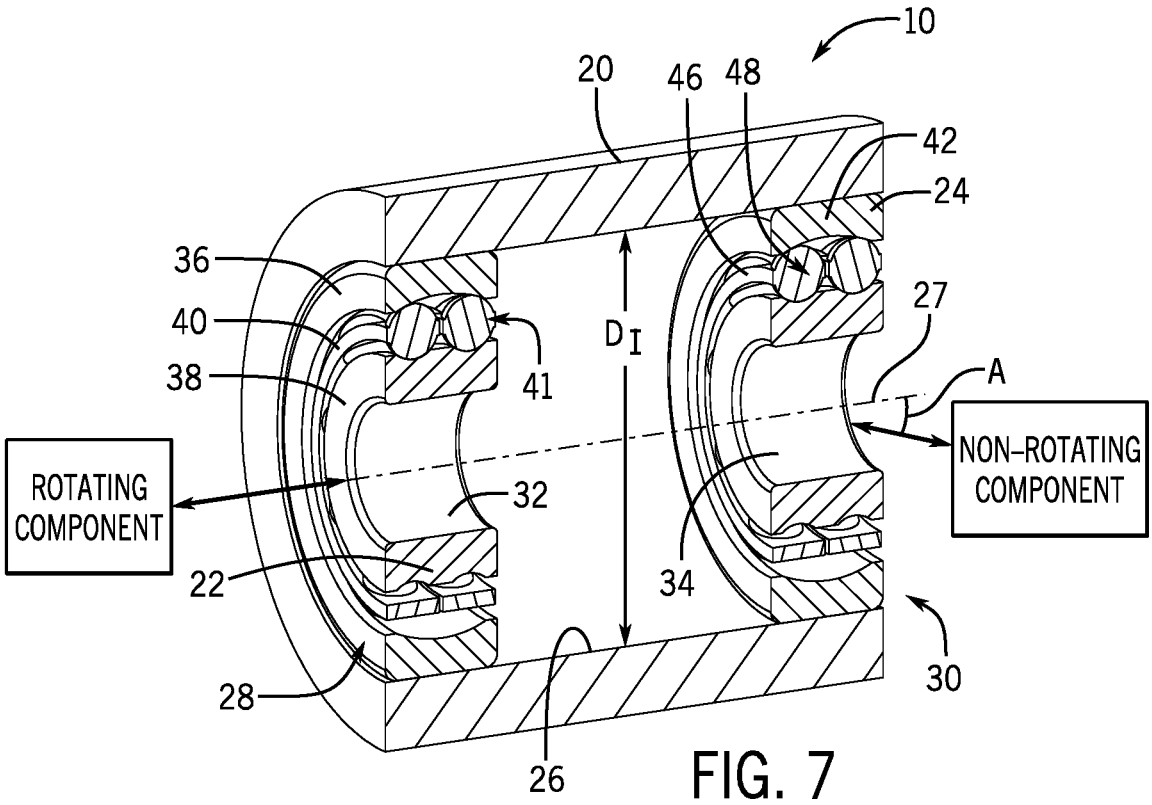
FIG. 7 is a schematic of the push-pull coupling of FIG. 3 coupled between a rotating component and an angularly and radially misaligned non-rotating component.

As described above, the push-pull coupling 10 is configured to accommodate axial and/or angular misalignment between the components coupled thereby. Various non-limiting examples of this functionality are illustrated in FIGS. 5-7. It should be appreciated that although the following non-limiting examples are described with respect to the non-limiting application of FIG. 1 they also apply to the non-limiting application of FIG. 2. As shown in FIG. 5, the push-pull coupling 10 may facilitate coupling between the rotating component 12 and the non-rotating component 14 when the non-rotating component 14 is axially misaligned. That is, the non-rotating component 14 may be axially offset from the center axis 27 and/or from a center axis defined by the rotating component 12. The design and properties of the push-pull coupling 10 may enable the coupling of the rotating component 12 and the non-rotating component 14 in this axially misaligned arrangement. In some non-limiting example, an axial length of the push-pull coupling 10 may control the amount of axial misalignment that the push-pull coupling 10 may accommodate. Specifically, an axial offset between the first bearing 22 and the second bearing 24 may allow the push-pull coupling 10 to tilt and the rotational freedom of the first and second bearings 22 and 24 may facilitate the coupling of axially misaligned components. In application, the axial length of the push-pull coupling 10 may be sufficient to accommodate a predetermined axial offset between the first bearing 22 and the second bearing 24. It should be appreciated that although the non-rotating component 14 is illustrated as axially misaligned, the push-pull coupling 10 may facilitate coupling if the rotating component 12 is also axially misaligned (e.g., from the center axis 27 and/or a center axis defined by the non-rotating component 14).

As shown in FIG. 6, the push-pull coupling may facilitate coupling between the rotating component 12 and the non-rotating component 14 when the non-rotating component 14 is angularly misaligned. That is, the non-rotating component 14 may be arranged such that an angle A is defined between a center axis of the non-rotating component 14 and the center axis 27. The design and properties of the push-pull coupling 10 may enable the coupling of the rotating component 12 and the non-rotating component 14 in this angularly misaligned arrangement. For example, as described above, the first inner ring 38 and the second inner ring 44 may be allowed to free rotate within the first outer ring 36 and the second outer ring 42, respectively. This rotational freedom of the first inner ring 38 and the second inner ring 44 may enable the coupling of an angularly misaligned component(s) without a loss in functionality of the push-pull coupling 10. It should be appreciated that although the non-rotating component 14 is illustrated as angularly misaligned, the push-pull coupling 10 may facilitate coupling if the rotating component 12 is also angularly misaligned.

In some non-limiting examples, the push-pull coupling 10 may facilitate the coupling of angularly misaligned components with the use of a single bearing. For example, the push-pull coupling 10 may be provided with one of the first bearing 22 and the second bearing 24 and be able to facilitate the coupling of angularly misaligned components. As described above, the use of two bearings provides the push-pull coupling 10 with the added advantage of being able to account for axial misalignment.

As shown in FIG. 7, the push-pull coupling may facilitate coupling between the rotating component 12 and the non-rotating component 14 when the non-rotating component 14 is radially and angularly misaligned. That is, the non-rotating component 14 may be arranged such that a center axis defined thereby is radially offset from the center axis 27 and/or a center axis defined by the rotating component 12, and the angle A is defined between the center axis of the non-rotating component 14 and the center axis 27. The design and the properties of the push-pull coupling 10 may enable the coupling of the rotating component 12 and the non-rotating component in this radially and angularly misaligned arrangement. For example, as described above, the first inner ring 38 and the second inner ring 44 may be allowed to free rotate within the first outer ring 36 and the second outer ring 42, respectively. This rotational freedom of the first inner ring 38 and the second inner ring 44, along with the length of the push-pull coupling 10 that provides the axial offset between the first and second bearings 22 and 24, may enable the coupling of an angularly and axially misaligned component(s) without a loss in functionality of the push-pull coupling 10. It should be appreciated that although the non-rotating component 14 is illustrated as radially and angularly misaligned, the push-pull coupling 10 may facilitate coupling if the rotating component is also radially and angularly misaligned.

In some non-limiting applications, the rotating component 12 or the first rotating component 16 may be one of the one of the spider rotors 18, 106, 206, 406, 506 or 606 described in the '352 patent and the non-rotating component 14 may be a linear actuator, or the like, configured to apply a linear force. In this application, the push-pull coupling 10 may enable the coupling of one of the spider rotors 18, 106, 206, 406, 506 or 606 to a linear actuator. Since the push-pull coupling 10 is configured to inhibit relative axial motion, the axial displacement provided by the linear actuator is directly transferred to the one of the spider rotors 18, 106, 206, 406, 506 or 606, thereby ensuring accurate phasing between the camshaft and the crankshaft. In addition, the push-pull coupling 10 enables the one of the spider rotors 18, 106, 206, 406, 506 or 606 to rotate with the camshaft (if necessary) without imparting this rotation on the linear actuator. In this way, the assembly and operation of the cam phasing system is simplified because the wiring to the linear actuator is not required to rotate. The assembly is further simplified because the push-pull coupling 10 is configured to accommodate for radial and/or angular misalignment between the one of the spider rotors 18, 106, 206, 406, 506 or 606 and the linear actuator.

Figure 8:
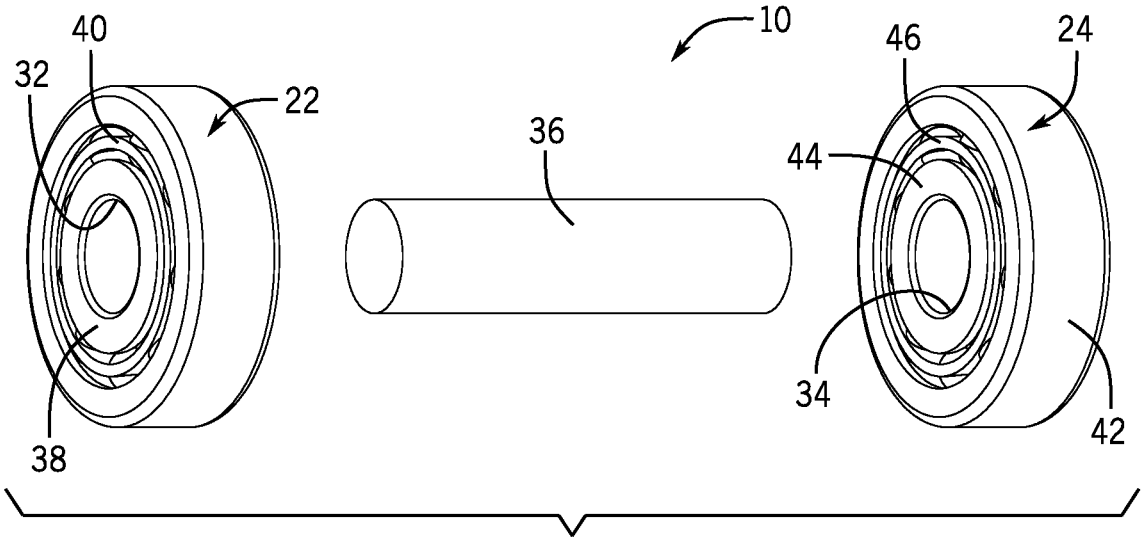
FIG. 8 is an exploded left, top, back isometric view of a push-pull coupling according to another aspect of the present disclosure.
Figure 9:
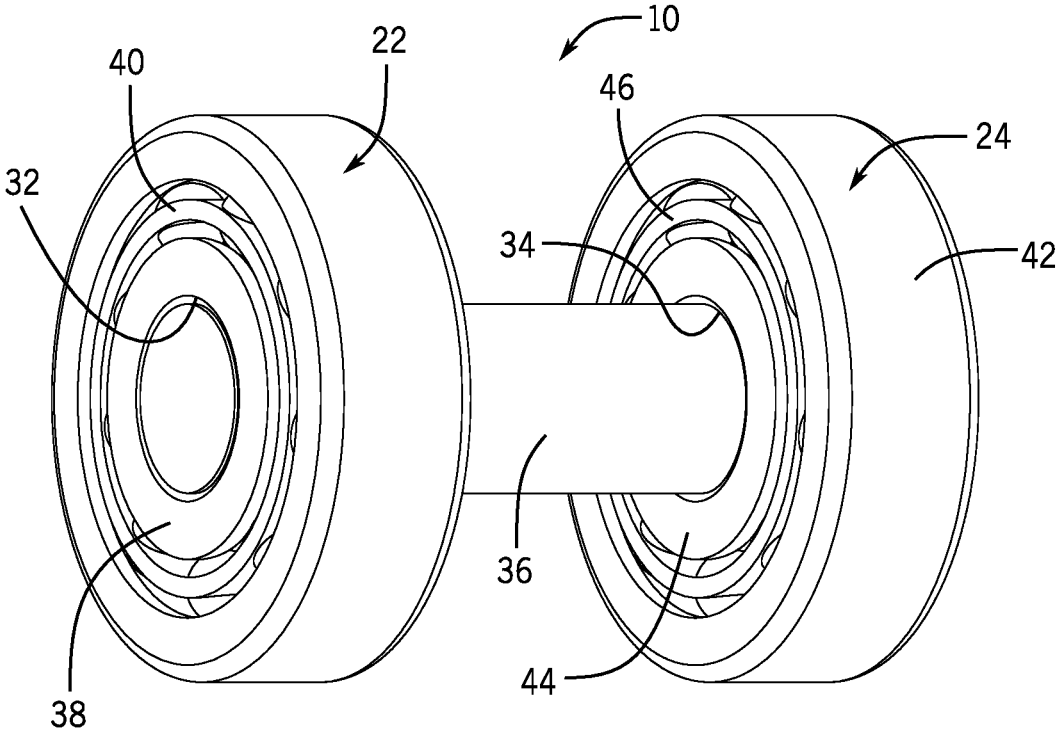
FIG. 9 is a left, top, back isometric view of the push-pull coupling of FIG. 8.
Figure 10:
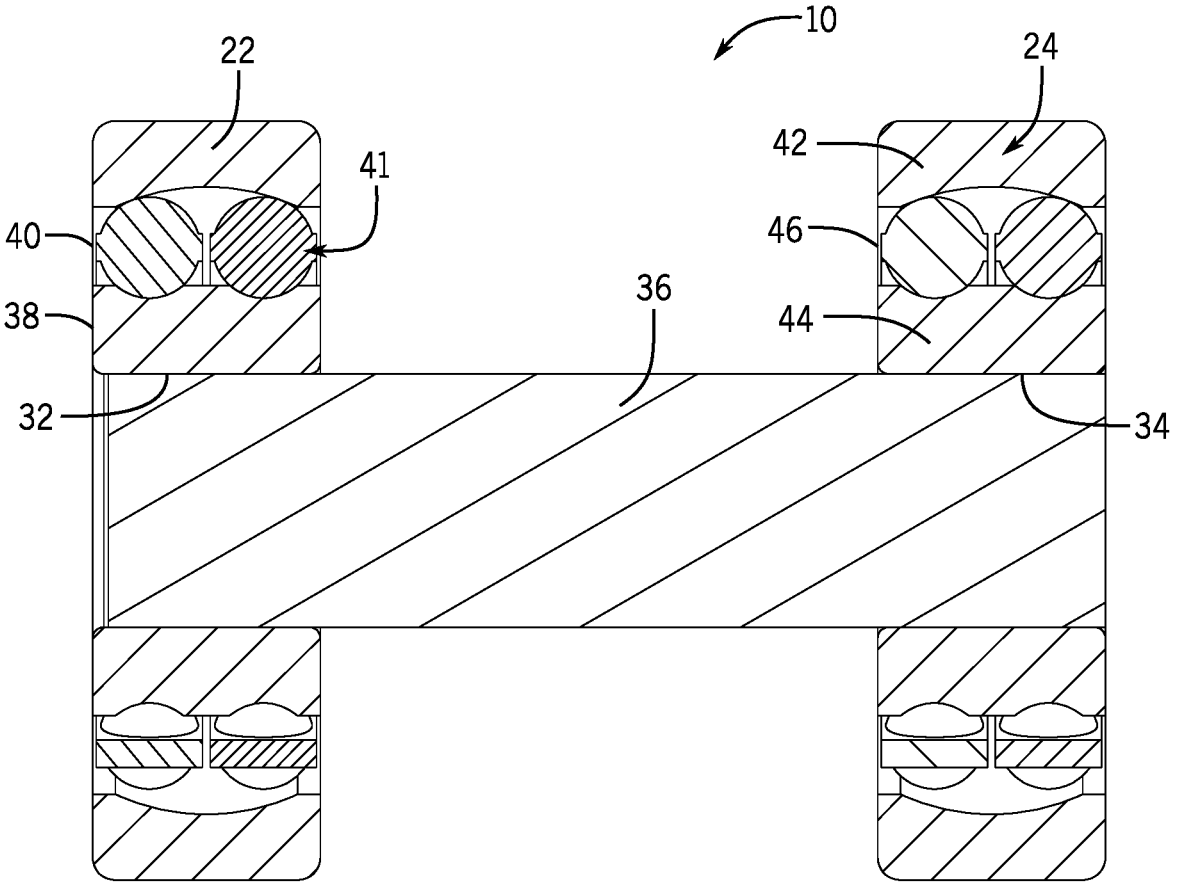
FIG. 10 is a cross-sectional view of the push-pull coupling of FIG. 8 taken along line 10-10 in FIG. 9.

It should be appreciated that alternative designs are possible for the push-pull coupling 10 that still inhibit relative axial motion but allow rotational motion, and can compensate for any type of radial and/or angular misalignment. For example, FIGS. 8-10 illustrate another non-limiting example of the push-pull coupling 10 according to one aspect of the present disclosure. As shown in FIGS. 8-10, the push-pull coupling 10 may not include the housing 20 but, instead, a shaft 36 may be used to connect the first and second bearings 22 and 24. The shaft 36 may be sized to be received within the first coupling aperture 32 of the first bearing 22 and the second coupling aperture 34 of the second bearing 24. In one non-limiting example, the shaft 36 may be press-fit into the first and second coupling apertures 32 and 34. In other non-limiting examples, another securing mechanism may be utilized to secure the shaft 36 within the first and second coupling apertures 32 and 34 (e.g., a keyed feature, a pin, etc.).

Figure 11:
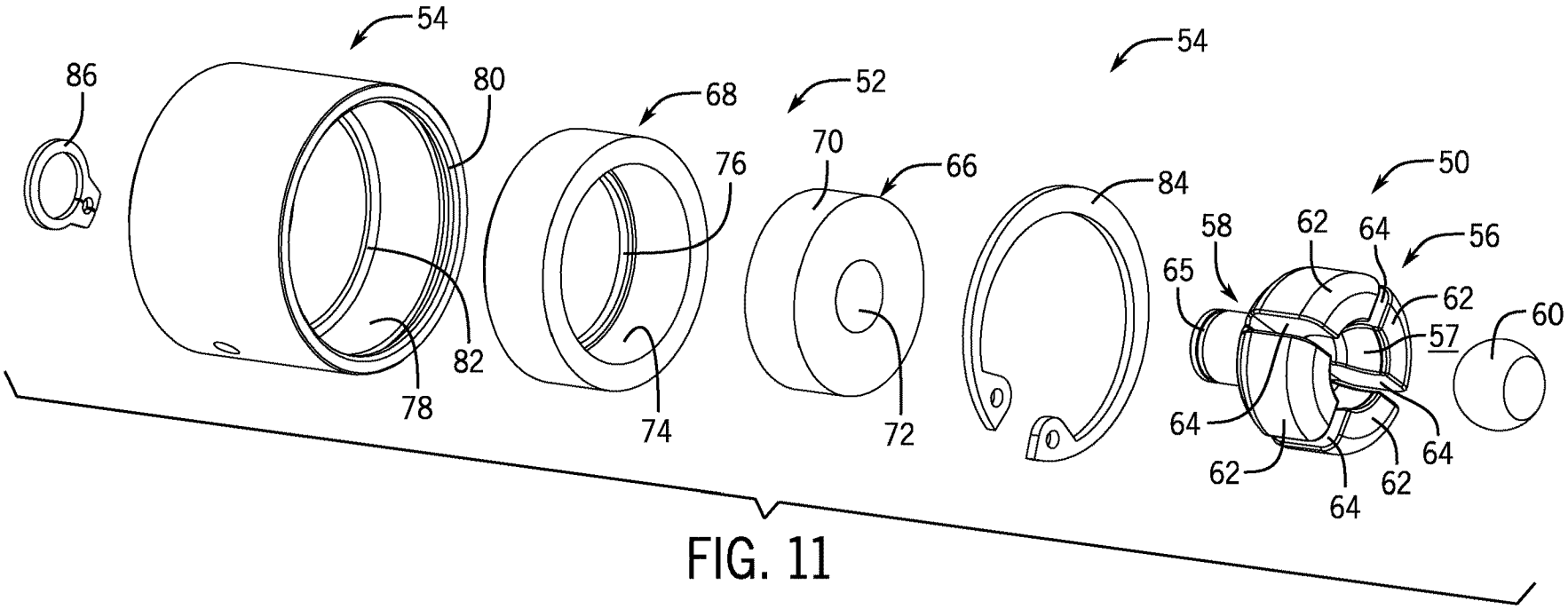
FIG. 11 is an exploded right, top, back isometric view of a push-pull coupling according to yet another aspect of the present disclosure.

FIG. 11 illustrates another non-limiting example of the push-pull coupling 10 according to one aspect of the present disclosure. As illustrated in FIG. 11, the push-pull coupling 10 may include an actuator coupling 50, a bearing assembly 52, and a housing 54. The actuator coupling 50 includes a coupling head 56 and a coupling shaft 58 extending axially away from the coupling head 56. The coupling head 56 defines a ball cavity 57 that is configured to receive and secure to an actuator ball 60 therein to facilitate the coupling of the actuator ball 60 to the actuator coupling 50. The actuator ball 60 may be attached to or integrated into an actuator (not shown) that is configured to apply an input force (e.g., an axial, or linear, force) to the actuator coupling 50.

The coupling head 56 includes a plurality of radially flexible arms 62 arranged circumferentially around the coupling head 56. The arms 62 are each separated by a slot 64 that extends radially through the coupling head 56. In the illustrated non-limiting example, the ball cavity 57 may be defined in a recess formed radially inward from the arms 62. The slots 64 formed in the coupling head 56 provide the radial flexibility to the arms 62, which may facilitate the insertion of the actuator ball 60 into the ball cavity 57 of the coupling head 56. In the illustrated non-limiting example, the coupling head 56 includes four arms 62 and a corresponding four slots 64. In other non-limiting examples, the coupling head 56 may include more or less than four arms 62 and/or more or less than four slots 64. The coupling shaft 58 includes a recessed notch 65 arranged at an end thereof arranged axially away from the coupling head 56.

In the illustrated non-limiting example, the bearing assembly 52 includes a bearing 66 and an inner housing 68. Each of the bearing 66 and the inner housing 68 defines a generally annular shape. The bearing 66 includes an outer surface 70 and an inner aperture 72 extending axially through a center of the bearing 66. The inner aperture 72 is configured to at least partially receive the coupling shaft 58 therein. The inner housing 68 is configured to at least partially receive the bearing 66 therein. Specifically, the inner housing 68 defines an inner surface 74 with an inner diameter that is dimensioned to receive the bearing 66 therein. The inner surface 74 of the inner housing 68 includes a notch 76 that protrudes radially inward and is arranged at one end thereof.

In some non-limiting examples, the bearing 66 may include one or more rollers (not shown) arranged radially between the inner aperture 72 of the bearing 66 and the outer surface 70 of the bearing 66 (see, e.g., the first bearing 22 and the second bearing 24). In this way, the bearing 66 may define a self-aligning bearing that is configured to compensate for misalignment, as will be described herein. In some non-limiting examples, the bearing 66 may be in the form of a spherical roller bearing, a spherical plain bearing, a self-aligning ball bearing, a toroidal roller bearings, a spherical roller thrust bearing, or another bearing that can handle misalignment.

In the illustrated non-limiting example, the housing 54 defines a generally annular shape. The housing 54 includes a stepped profile on an inner surface 78 thereof and a recessed notch 80 that extends radially into the housing 54 at an end thereof. The inner surface 78 defines a stepped profile that decreases in diameter at a notch 82 arranged axially between the opposing ends of the housing 54. In some non-limiting examples, the notch 82 may be arranged axially at a location that enables the inner housing 68 to be axially inserted completely into the housing 54.

Figure 12:
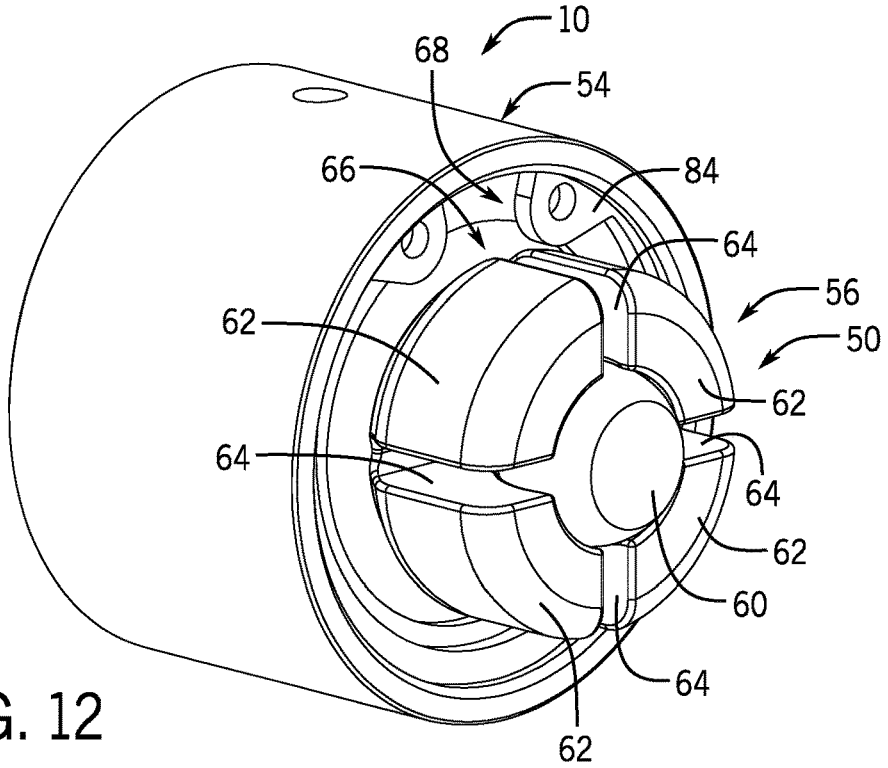
FIG. 12 is a right, top, back isometric view of the push-pull coupling of FIG. 11.
Figure 13:
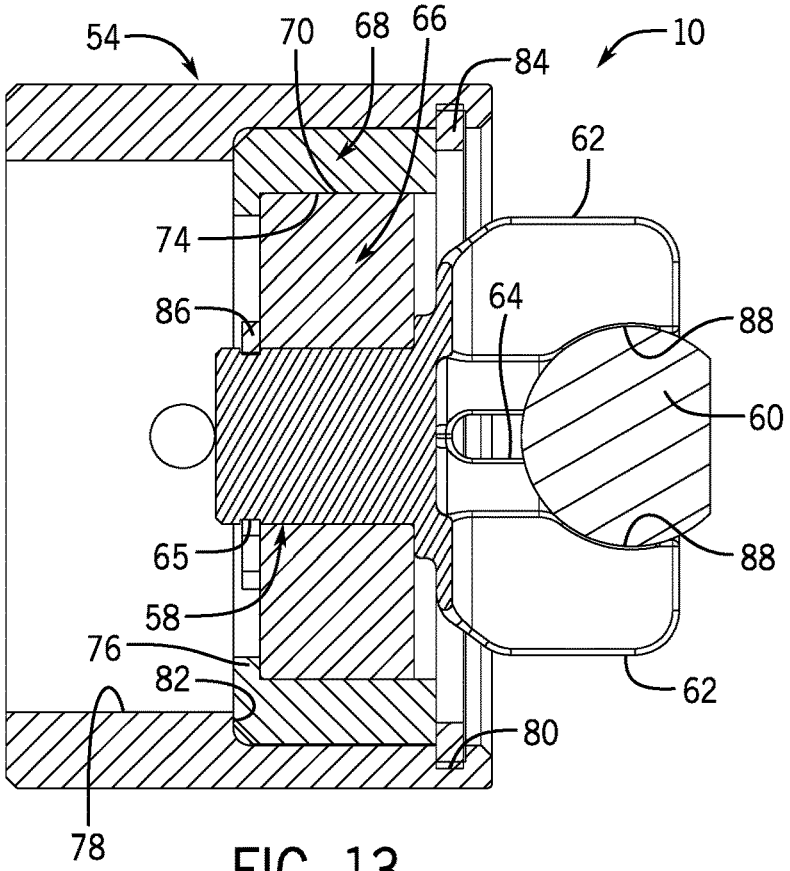
FIG. 13 is a cross-sectional view of the push-pull coupling of FIG. 11 taken along line 13-13 in FIG. 12.

With reference to FIGS. 11-13, the push-pull coupling 10 may be assembled by axially inserting the bearing 66 into the inner surface 74 of the inner housing 68 until the bearing 66 engages the notch 76, which limits the axial displacement of the bearing 66 along the inner surface 74. With the bearing 66 axially inserted into the inner housing 68, the resulting assembly 52 may be axially inserted into the inner surface 78 of the housing 54 until the inner housing 68 engages the notch 82, which limits the axial displacement of the inner housing 68 along the inner surface 78. A snap ring 84 may then be inserted into the recessed notch 80. With the snap ring 84 installed into the recessed notch 80, the bearing 66 and inner housing 68 may be axially fixed within the housing 54.

The coupling shaft 58 may then be axially inserted through the inner aperture 72 of the bearing 66, such that the recessed notch 65 of the coupling shaft 58 axially extends through the inner aperture 72. A shaft snap ring 86 may then be installed into the recessed notch 65 of the coupling shaft 58 to axially fix the actuator coupling 50 with respect to the bearing 66, the inner housing 68, and the housing 54. With the push-pull coupling 10 assembled, the actuator ball 60 may be inserted into the ball cavity 57. Specifically, the arms 62 may displace radially outward to enable the actuator ball 60 to slide into the ball cavity 57. Each of the arms 62 includes a curved surface 88 arranged on the radially inner face thereof that is configured to conform to the outer surface of the actuator ball 60. Once the actuator ball 60 is completely inserted into the ball cavity 57, the curved surfaces 88 engage the outer surface of the actuator ball 60 and the radial flexibility of the arms 62 provides a contact force on the actuator ball 60 to couple the actuator ball 60 and the actuator (not shown) to the actuator coupling 50. It should be appreciated that the above-described steps for assembling the push-pull coupling 10 are not meant to be limiting in any way and that the push-pull coupling 10 may be assembled in an alternative order.

In some non-limiting applications, the housing 54 may be coupled to the rotating component 12 or the first rotating component 18. For example, the housing 54 may be rotationally coupled to a component with a cam phasing system and/or the housing 54 may be integrated into a cam phasing system and rotate therewith. In any case, the housing 54 may rotate with a cam phasing system and the inner housing 68 may rotate with the housing 54. In some non-limiting examples, a frictional fit may exist between the inner housing 68 and the inner surface 78 of the housing 54. In some non-limiting examples, the inner housing 68 may be keyed to, or otherwise rotationally fixed to, the housing 54. The inner aperture 72 or the bearing 66 may be inhibited from rotating with the inner housing 68. For example, a frictional fit between the coupling shaft 58 and the inner aperture 72 of the inner bearing 66 may inhibit rotation of the inner aperture 72 of the bearing 66 with the inner housing 68. In some non-limiting examples, the coupling shaft 58 may be keyed to, or otherwise rotationally fixed to, the inner aperture 72 of the bearing 66.

As described above, the bearing 66 may include one or more rollers or balls (not shown) arranged radially between the inner aperture 72 of the bearing 66 and the outer surface 70 of the bearing 66. These rollers may facilitate the rotation of the surface 70 of the bearing 66 with respect to the inner aperture 72 of the bearing 66. In addition, the bearing 66 may function similar to the first bearing 22 and the second bearing 24 described herein. For example, the inner aperture 72 of the bearing 66 may be allowed to move rotationally in any orientation relative to the outer surface 70 of the bearing 66. That is, the inner aperture 72 of the bearing 66 may be able to rotate three-dimensionally within the outer surface 70 of the bearing 66 to compensate for various angular and/or axial misalignments between the cam phasing system and the actuator (not shown). Alternatively or additionally, the actuator ball 60, which is coupled to or integrated into the actuator (not shown), may be rotationally coupled within the ball cavity 57 to provide additional misalignment compensation.

In some mechanical systems, relative motion is needed between two or more components. The relative motion may be, for example, linear, axial, rotational, or helical to name a few. In some examples, the relative motion may be initiated by an input force provided by one component directly or indirectly onto another component. In these systems, the relative motion between the two or more components may be spontaneously locked at one or more intervals of time. During these locking events, the components may be prevented from moving relative to one another. For example, external forces such as frictional forces, torque pulses, or the like may be applied to the system inhibiting the desired relative motion. These locking events may inhibit the input force from being transferred to the component and, thus, the component may not relatively move as desired. As such, the input force must be timed appropriately to be applied at times that do not overlap with the locking events, which increases complexity and design of the mechanical system.

One non-limiting example of such a mechanical system is a cam phasing application. In a cam phasing application, the goal is to change the phase angle (i.e., a rotational relationship) between a camshaft and a crankshaft on, for example, an internal combustion engine. Changing the phase angle in a cam phasing system may be accomplished by a variety of actuation mechanisms. For example, various cam phasing systems and methods that may be applicable to the present disclosure are described in the '352 patent.

As described in the '352 patent, in some cam phasing systems, axial motion (e.g., via a linear actuator) may be translated into rotational motion that alters the phase between the camshaft and the crankshaft. In these arrangements, an axial force is applied to provide linear motion and actuate the system. However, in some other cam phasing systems, a rotational input force may be applied to alter the phase between the camshaft and the crankshaft. Regardless of the input mechanism, during engine operation, there are torque pulses on the camshaft created by the force of the cam lobes on the valve springs. These torque pulses occur in both positive and negative directions during an engine cycle (i.e., in clockwise and counterclockwise directions). The occurrence of the torque pulses may create large external forces, which lock the system during either positive or negative torques (depending on the actuation, or phasing, direction) and prevent the phase angle alteration. The phase angle may only be altered by the system when the torque pulses on the camshaft are removed or applied in the same direction as the desired phase direction. Thus, there is no assurance that a desired phase angle change may occur in response to a given input force.

In an attempt to overcome this potential operational inefficiency, the present disclosure provides a compliance mechanism configured to enable an input displacement to be provided regardless of outside forces and to ensure that a desired final position is reached.

Figure 14:
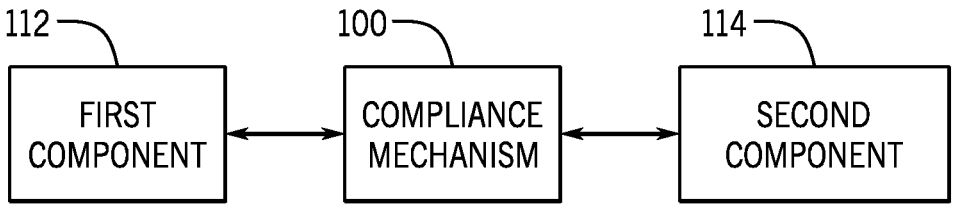
FIG. 14 is a schematic of a compliance mechanism arranged between a first component and second component according to one aspect of the present disclosure.

FIG. 14 illustrates one non-limiting application of a compliance mechanism 100 according to one aspect of the present disclosure. As shown in FIG. 14, the compliance mechanism 100 is configured to be coupled between a first component 112 and a second component 114. In the illustrated non-limiting example, a certain displacement is desired for the second component 114. The second component 114 may be configured to move relatively (e.g., axially, rotationally, helically, etc.) in a first direction or a second direction with respect to a frame of reference in response to an input displacement applied by the first component 112. The input displacement provided by the first component 112 is configured to move the second component 114 in either the first direction or the second direction (i.e., a desired direction) toward a desired position. That is, the amount of input displacement provided by the first component 112 may be directly proportional to an amount of desired movement of the second component 114 in the desired direction, such that the second component 114 reaches the desired position. The term "desired direction" used herein refers to a direction (e.g., either the first direction or the second direction) that that second component 114 is moved to reach the desired position. However, it should be appreciated that, in other non-limiting examples, the first component 112 may be configured to move relatively (e.g., axially, rotationally, helically, etc.) in the first direction or the second direction in response to an input displacement applied by the second component 114.

In operation, the second component 114 may be subjected to external forces (e.g., axial, rotational, helical, etc.) in the first direction or the second direction, which may lock the second component 114 (depending on the desired direction of motion) and thereby inhibit the second component 114 from moving to the desired position. The compliance mechanism 100 is configured to enable the first component 112 to apply an input displacement at any time regardless of when the external forces are applied and ensure that the second component 114 reaches the desired position. For example, the first component 112 may provide an input displacement at a desired time. If the external forces are applied at this time or any time during the motion toward the desired position, the compliance mechanism 100 is configured to ensure that input displacement applies forces to the second component 114 until it reaches the desired position. That is, the compliance mechanism 100 is configured to transfer the input displacement applied by the first component 112 to the second component 114 when the external forces are removed, not present, in the opposite direction as the desired direction, and in the same direction as the desired direction. Thus, the compliance mechanism 100 will continue to transfer the input force from the first component 112 to the second component 114 until the second component 114 reaches the desired position.

Figure 15:
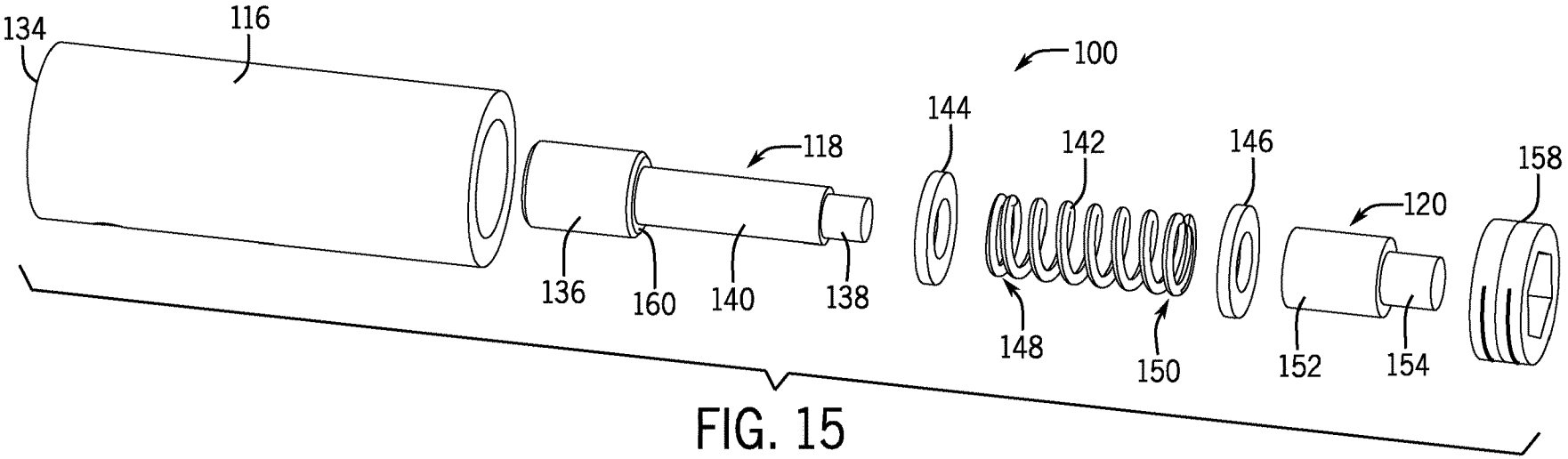
FIG. 15 is an exploded left, top, back isometric view of a compliance mechanism according to one aspect of the present disclosure.
Figure 16:
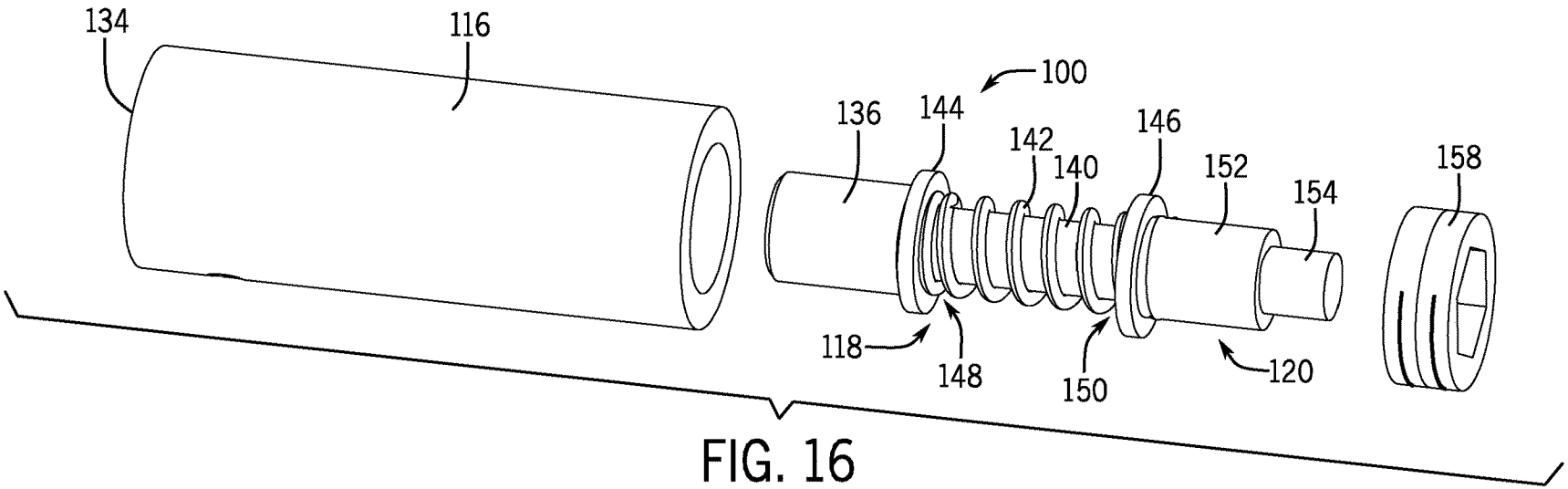
FIG. 16 is a partially exploded left, top, back isometric view of the compliance mechanism of FIG. 15.
Figure 17:
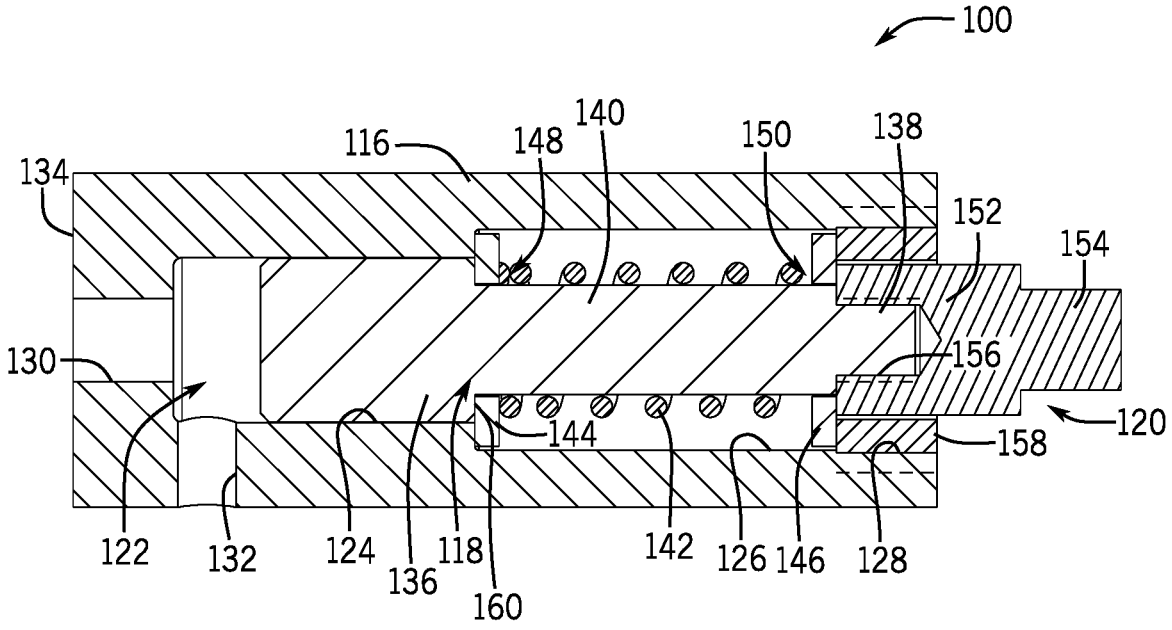
FIG. 17 is a cross-sectional view of the compliance mechanism of FIG. 15 with the compliance mechanism assembled taken along line 17-17 in FIG. 16.

FIGS. 15-17 illustrate one non-limiting example of the compliance mechanism 100 according to one aspect of the present disclosure. As illustrated in FIGS. 15-17, the compliance mechanism 100 includes a housing 116, a first pin 118, and a second pin 120. The housing 116 defines a generally cylindrical shape. In other non-limiting examples, the housing 116 may define another shape, for example, oval, rectangular, polygonal, etc., as desired. The housing 116 includes an inner bore 122 that defines an actuation chamber 124, a spring chamber 126, and a threaded bore 128. The inner bore 122 defines a stepped geometry with the diameter of the threaded bore 128 being greater than the diameter of the spring chamber 126, and the diameter of the spring chamber 126 being greater than the diameter of the actuation chamber 124. It should be understood that this is but one non-limiting design of the inner bore 122 and, in other non-limiting designs the inner bore 122 may define, for example, a uniform geometry.

The actuation chamber 124 includes a coupling aperture 130 and a relief port 132. The coupling aperture 130 extends axially into the housing 116 from a first side 134 of the housing 116. The housing 116 may be configured to be coupled to one of the first component 112 and the second component 114. In particular, the coupling aperture 130 of the housing 116 may be configured to be coupled to one of the first component 112 and the second component 114. The relief port 132 extends radially through the housing 116 and provides fluid communication between the actuation chamber 124 and the surrounding atmosphere.

The first pin 118 includes a first end 136, a second end 138 and a spring portion 140 arranged between the first end 136 and the second end 138. The first end 36 is dimensioned to be slidably received with in the actuation chamber 124 of the inner bore 122. A biasing element 142 is configured to be arranged along and around the spring portion 140 of the first pin 118. The illustrated biasing element 142 is in the form of a spring. The spring 142 is configured to be compressed between a first washer 144 and second washer 146. The first washer 144 is dimensioned such that the spring portion 140 of the first pin 118 extends therethrough. The first washer 144 is dimensioned to be slidably received within the spring chamber 126 of the inner bore 122. The first washer 144 is configured to act as a stop for a first side 148 of the spring 142. The second washer 146 is dimensioned such that the spring portion 140 of the first pin 118 extends therethrough. The second washer 146 is dimensioned to be slidably received within the spring chamber 126 of the inner bore 122. The second washer 146 is configured to act as a stop for a second side 150 of the spring 142 opposite the first side 148.

The second pin 120 includes a first end 152, a second end 154, and a coupling aperture 156. The second pin 120 may be configured to be coupled to the other of the first component 112 and the second component 114 not coupled to the housing 116. In particular, the second end 154 of the second pin 120 may be configured to be coupled to the other of the first component 112 and the second component 114 not coupled to the housing 116. The second pin 120 may be configured to be coupled to the first pin 118. In particular, the coupling aperture 156 of the second pin 120 may be configured to be coupled to the second end 138 of the first pin 118. A threaded cap 158 defines a generally annular shape and is dimensioned to be slidably receive at least a portion of the second end 154 of the second pin 120 therethrough. The threaded cap 158 is dimensioned to be received within the threaded bore 128 of the inner bore 122.

Figure 18:
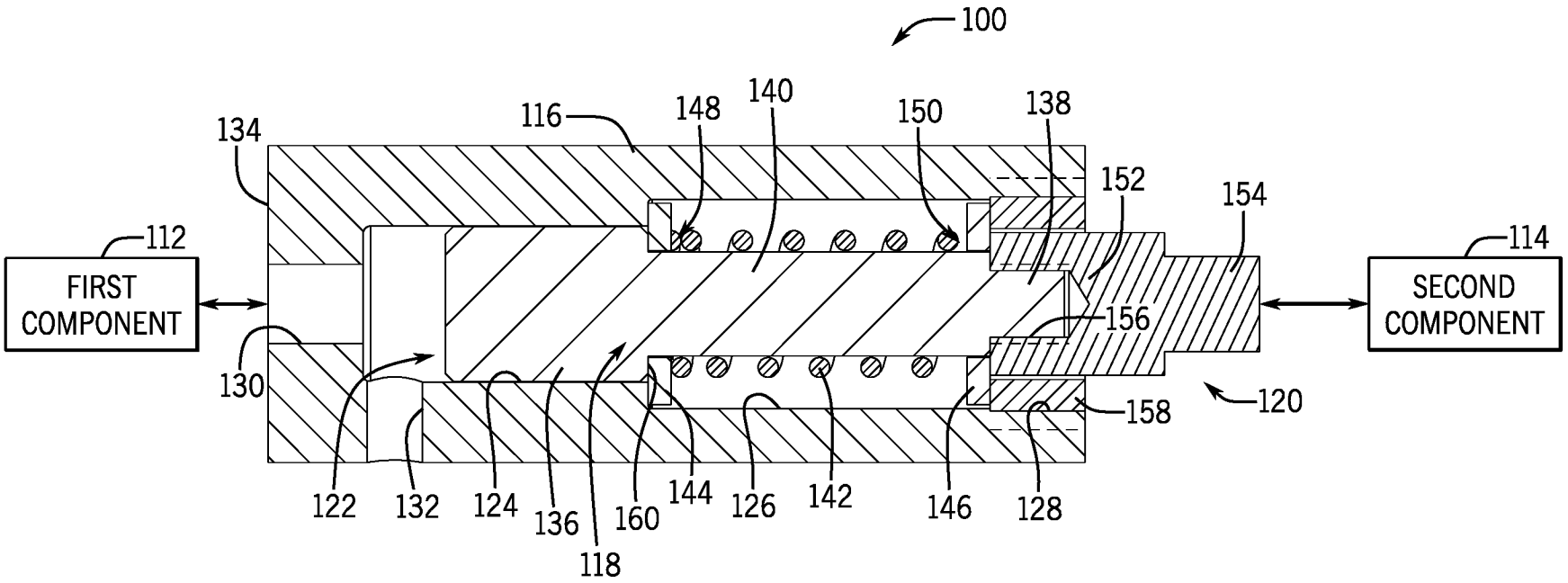
FIG. 18 is a cross-sectional view of the of the compliance mechanism of FIG. 15 with the compliance mechanism coupled to a first component and a second component taken along line 18-18 in FIG. 16.

One non-limiting example of operation of the compliance mechanism 100 will be described with reference to FIG. 18. In this non-limiting example, the housing 116 may be coupled to the first component 112 and the second pin 120 may be coupled to the second component 114. The first component 12 may be configured to provide an input displacement (e.g., an axial, rotational, or helical input displacement) that directly corresponds to a desired direction and magnitude of movement (e.g., axial, rotational, or helical motion) of the second component 114. However, it should be appreciated that the following properties and advantages may also be applied to the non-limiting example where the second component 114 provides an input displacement that directly corresponds to a desired direction and magnitude of movement of the first component 112.

During operation, the second component 114 may be configured to move relative to a frame of reference in the first direction or the second direction to a desired position, in response to an input displacement provided by the first component 112. A magnitude and direction provided by the input displacement of the first component 112 are directly correlated to a desired position of the second component 114. However, during operation, the second component 114 may be subjected to external forces (e.g., axial, rotational, helical, etc.) in the first direction or the second direction, which may lock the second component 114 (depending on the desired direction of motion) and thereby inhibit the second component 114 from moving to the desired position.

Initially, a first relative relationship may be defined between the housing 116 and the first and second pins 118 and 120. When it is desired to move the second component 114 relative to the frame of reference, the first component 112 may be instructed, electronically, hydraulically, mechanically, or by a combination thereof, to provide an input displacement with a predetermined magnitude and direction to the housing 116. For example, the input displacement may be provided in a direction from the first washer 144 toward the second washer 146. When assembled, the spring 142 may be preloaded such that the first washer 144 and the second washer 146 are biased away from one another. Thus, when no input displacement is provided, the first washer 144 may be biased against a flange 160 defined at a junction between the first end 136 and the spring portion 140 of the first pin 118, and also the first washer 144 may be biased against a seat 162 defined at a junction between the actuation chamber 124 and the spring chamber 126 of the inner bore 122. The second washer 146 may be biased against the first end 152 of the second pin 120, and also against the threaded cap 158. This preload provided by the spring 142 ensures that an input displacement provided by the first component 112 is directly transferred to the second component 114 through the compliance mechanism 100 with no lag.

The input force applied to the housing 116 may cause the housing 116 to translate, for example, in a direction toward the second washer 146 thereby compressing the spring 142. Thus, the first relative relationship defined initially between the housing 116 and the first and second pins 118 and 120 may be altered to a second relative relationship. The further compression of the spring 142 provided by the displacement of the housing 116 may directly transfer a resulting force through the spring 142 to the second washer 146 and thereby to the first pin 118 and the second pin 120 via the engagement of the second washer 146 and the second pin 120. As such, the housing 116 may be displaced a desired amount in a desired direction due to the input force provided by the first component 112. Since the second pin 120 is coupled to the second component 114, this displacement of the first pin 118 and the second pin 120 may be transferred to the second component 114 thereby causing the second component 114 to displace in either the first direction or the second direction to the desired position. Thus, the housing 116 and the first and second pins 118 and 120 transition from the second relative relationship back to the first relative relationship. The relief port 132 within the housing 116 ensures that there is no pressure buildup or vacuum generated within the actuation chamber 124 during movement of the first pin 118 and second pin 120.

As described above, external forces may be applied to the second component 114 in either the first direction or the second direction. The design and properties of the compliance mechanism 100 ensure that the input displacement provided by the first component 112 is transferred to the second component 114 regardless of the timing and direction of the external forces. This is accomplished via the compression of the spring 142 constantly applying force relative to the input displacement to the second component 114. The constant force applied by the spring 142 may ensure that the second component 114 may be continually moved toward the desired position when the external forces are not present, removed, or in the same direction as the desired direction. Therefore, the second component 114 will continually move toward the desired position, when allowed, until the desired position is reached. Thus, the compliance mechanism 100 enables the input displacement to be applied at any desired time and ensures that force is continually transferred to the second component 114 until the second component 114 inevitably reaches the desired position.

In some non-limiting applications, one of the first component 112 and the second component 114 may be one of the one of the spider rotors 18, 106, 206, 406, 506 or 606 described in the '352 patent and the other of the first component 112 and the second component 114 may be a linear actuator, or the like, configured to apply an axial, or linear force. In this application, the compliance mechanism 100 may ensure that an input force provided by the actuator is continually applied to one of the spider rotors 18, 106, 206, 406, 506 or 606 regardless of the direction and magnitude of the cam torque pulses. This may enable the input force provided by the linear actuator to be applied at any desired time, thereby making the operation and control of the cam phasing system more efficient. Furthermore, the compliance mechanism 100 ensures that the one of the spider rotors 18, 106, 206, 406, 506 or 606 inevitably reach the desired phase angle.

In the non-limiting examples described above with reference to FIGS. 15-18, the compliance mechanism 100 may be arranged at least partially outside of the cam phase actuator of a cam phasing system. For example, the compliance mechanism 100 may be directly coupled to the device providing the input force to the cam phase actuator. In some non-limiting examples, the compliance mechanism 100 may be integrated into a cam phase actuator. For example, FIG. 19 illustrates another non-limiting configuration of the compliance mechanism 100 that may be integrated into or arranged internally within a cam phase actuator.

Figure 19:
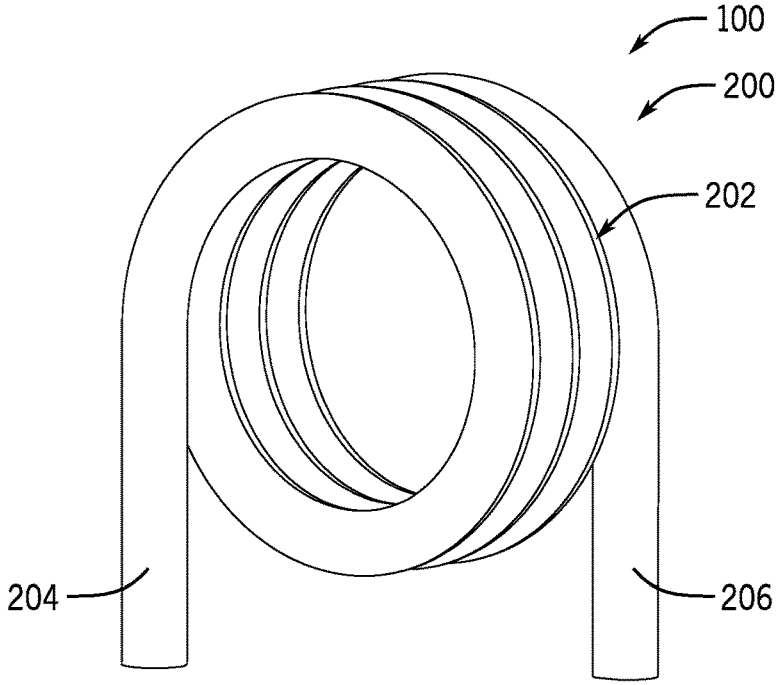
FIG. 19 is a right, top, front isometric view of an internal compliance mechanism according to another aspect of the present disclosure.

As illustrated in FIG. 19, the compliance mechanism 100 may be in the form of a coil 200 that includes a coil portion 202, a first end 204, and a second end 206. The coil 200 may be formed as a unitary component from a single winding of material. In some non-limiting examples the coil 200 may be pre-biased such that the first end 204 and the second end 206 extend away from one another in the free state. For example, the first end 204 and the second end 206 may extend away from one another to form a generally V-shape with the coil portion 202 in the free state. The coil portion 202 defines a generally round coil winding that acts as a spring to absorb biasing forces applied thereto by one or both of the first end 204 and the second end 208.

Figure 20:
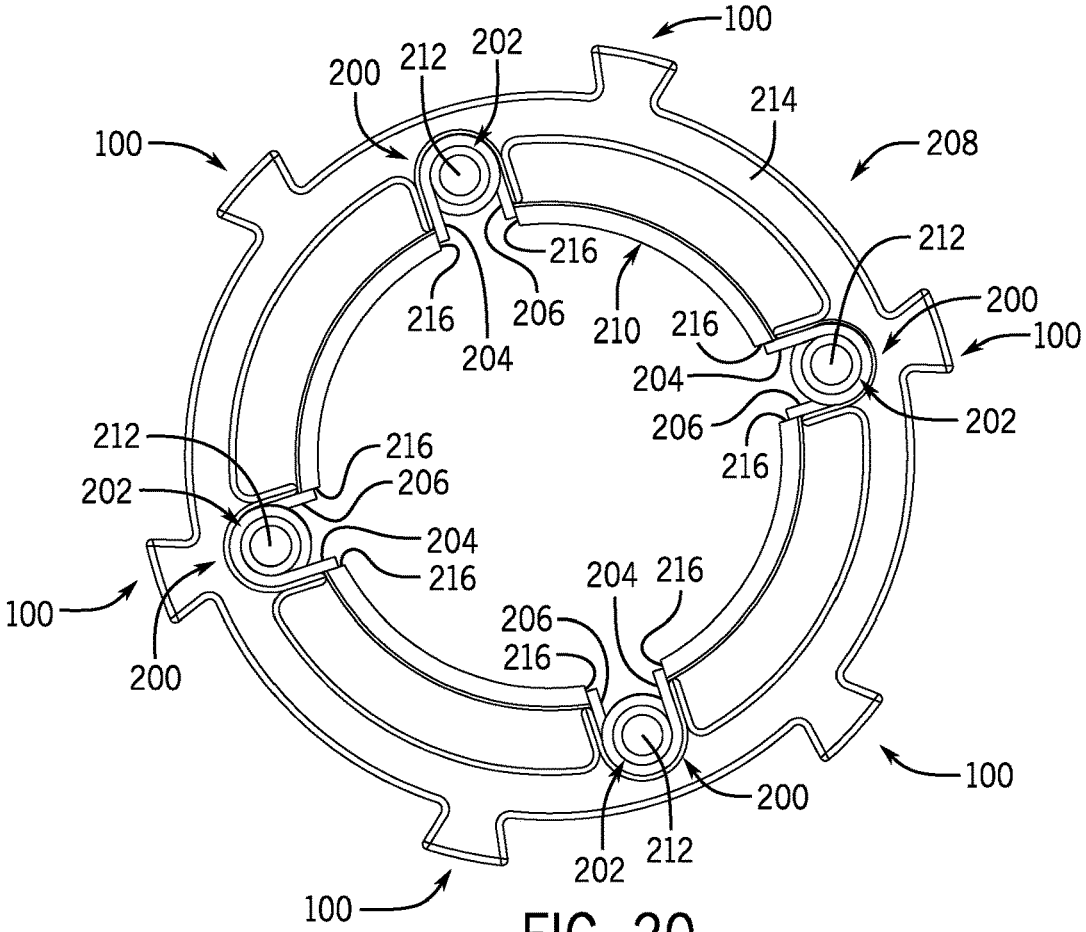
FIG. 20 is a front view of the internal compliance mechanism assembled within a cam phasing system according to one aspect of the present disclosure.

FIG. 20 illustrates one non-limiting example of the coil 200 installed within a cam phase actuator. For illustrative purposes, the certain components of the cam phase actuator are transparent and it should be appreciated that the illustrated components may be housed within the cam phase actuator. As illustrated in FIG. 20, the coil 200 may be coupled between a first cam phasing component 208 and a second cam phasing component 210. In some non-limiting examples, the first cam phasing component 208 can be a spider rotor (e.g., one of the spider rotors described in the '352 patent, or another spider rotor arranged within a cam phase actuator) configured to displace in response to an input displacement applied either directly or indirectly to the second cam phasing component 210. In some non-limiting examples, the second cam phasing component 210 may be coupled directly or indirectly (e.g., via one or more intermediate components) to an actuator (not shown) configured to apply an input displacement to the cam phase actuator.

In the illustrated non-limiting example, four of the coils 200 are installed into the cam phase actuator. In other non-limiting examples, the cam phase actuator may include more or less than four coils 200 to provide the functionality of the compliance mechanisms 100 described herein. To facilitate coupling the coils 200 to the first cam phasing component 208, the first cam phasing component 208 may include a plurality of protrusions 212 extending axially away from a first surface 214 thereof. The number of protrusions may correspond with the number of coils 200 installed in the cam phase actuator. The protrusions 212 may define a generally cylindrical shape and may be received within and extend through the coil portion 202 of the springs 200. When installed, the first and second ends 204 and 206 of the coils 200 extend radially inward and engage slots 216 formed in the second cam phasing component 210. With the coils 200 installed, the slots 216 of the second cam phasing component 210 may bias the first and second ends 204 and 206 toward one another, relative to the free state thereof. Thus, the pre-bias of the coils 200 may ensure that force is always transferred between the first cam phasing component 208 and the second cam phasing component 210.

In operation, an input displacement may be applied to the second cam phasing component 210 with a desired magnitude and direction. For example, the second cam phasing component 210 may be rotated relative to the first cam phasing component 208 to a known rotary location. Upon rotation of the second cam phasing component 210, the slots 216 engage and bias one of the first ends 204 and the second ends 206 (depending on the direction of the input force) circumferentially toward the other of the first ends 204 and the second ends 206. This circumferential biasing of one of the first ends 204 and the second ends 206 results in the coil portions 202 applying a corresponding force onto the protrusions 212 and thereby the first cam phasing component 208. The force applied to the first cam phasing component by the coils 200 will be maintained thereon until the first cam phasing component 208 reaches the desired position determined by the input displacement applied to the second cam phasing component 210. Thus, whether arranged within or at least partially externally from a cam phase actuator, the compliance mechanism 100 described herein ensures that a force may be continuously transferred from a first component to a second component until the second component reaches a desired position.

In some non-limiting examples, the use of the compliance mechanism 100 enables cam phasing systems to be constructed more efficiently by requiring fewer components to facilitate the phase angle change. Thus, the use of the compliance mechanism 100 may facilitate the design and operation of simplified cam phasing systems utilizing a minimized number of components.

Figure 21:
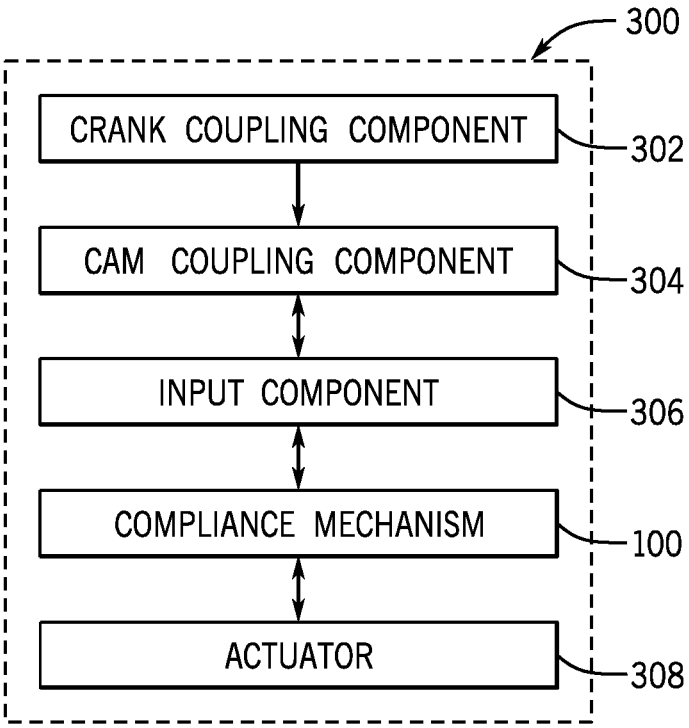
FIG. 21 is a schematic of a cam phasing system according to one aspect of the present disclosure.

FIG. 21 illustrates a one non-limiting schematic of one such cam phasing system 300 according to one aspect of the present disclosure. As shown in FIG. 21, the cam phasing system 300 may include a crank coupling component 302, a cam coupling component 304, and an input component 306. The crank coupling component 302 is configured to be coupled (e.g., via a gear train or a belt) to a crankshaft (not shown) of an internal combustion engine. The cam coupling component 304 is configured to be coupled to the crank coupling component 302 and to a camshaft (not shown) of the internal combustion engine. Thus, the cam phasing system 300 is configured to be coupled to the camshaft and the crankshaft of the internal combustion engine to enable the relative relationship (i.e., the phase angle) to be altered therebetween.

The input component 306 is configured to be in engagement, directly or indirectly, with the cam coupling component 304. The input component 306 is configured to move in response to an input force applied thereto. In some non-limiting examples, the cam coupling component 304 and/or the input component 306 may include helical features to enable the cam coupling component 304 to rotate in response to the input force, thereby altering the rotational orientation of the cam coupling component 304 relative to the crank coupling component 302.

The input force may be applied by an actuator 308 and transferred to the input component 306 by the compliance mechanism 100. The compliance mechanism 100 may prevent high forces from being applied to the actuator 308 and ensure that the actuator 308 always achieves full desired motion. The compliance mechanism 100 may thereby allow the cam coupling component 304 to rotate to the desired phase angle regardless of the direction and magnitude of the cam torque pulses. That is, the compliance mechanism 100 may allow the cam coupling component 304 to adjust is phase when the cam torque pulses are either removed or in the same direction as the desired phase change.

Figure 22:
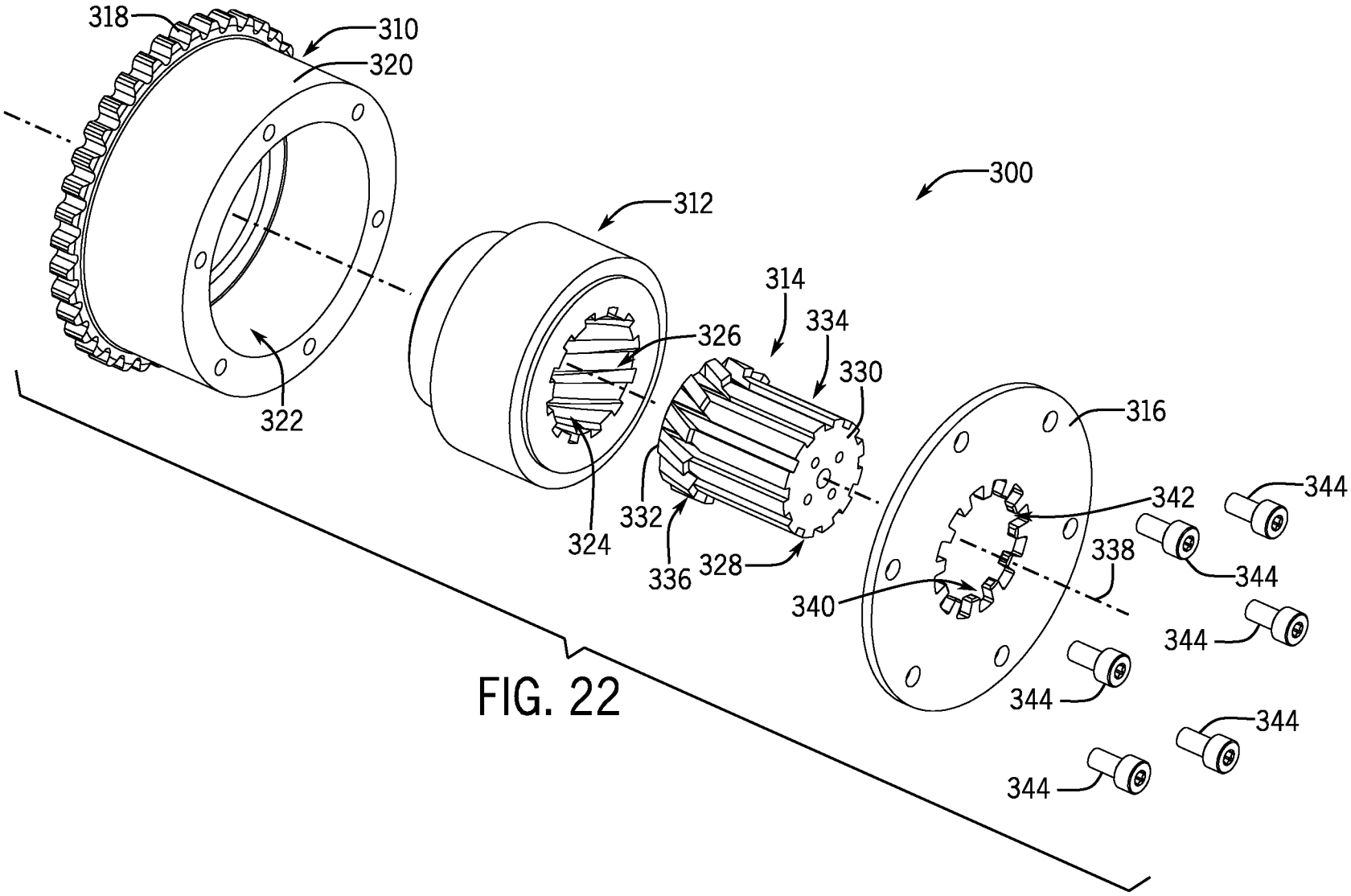
FIG. 22 is an exploded top, front, right isometric view of a cam phasing system according to one aspect of the present disclosure.

The presence of the cam torque pulses may require a locking design to be integrated into the cam phasing system 300 to prevent unwanted relative movement of the input component 306 in response to the cam torque pulses applied to the cam coupling component 304. For example, FIG. 22 illustrates the cam phasing system 300 that includes a helical locking design. In the illustrated non-limiting example, the crank coupling component 302 may be in the form of a sprocket hub 310, and the cam coupling component 304 may be in the form of a cradle rotor 312. The input component 306 may be in the form of a helix rod 314. The cam phasing system 300 may also include an end plate 316.

Figure 23:
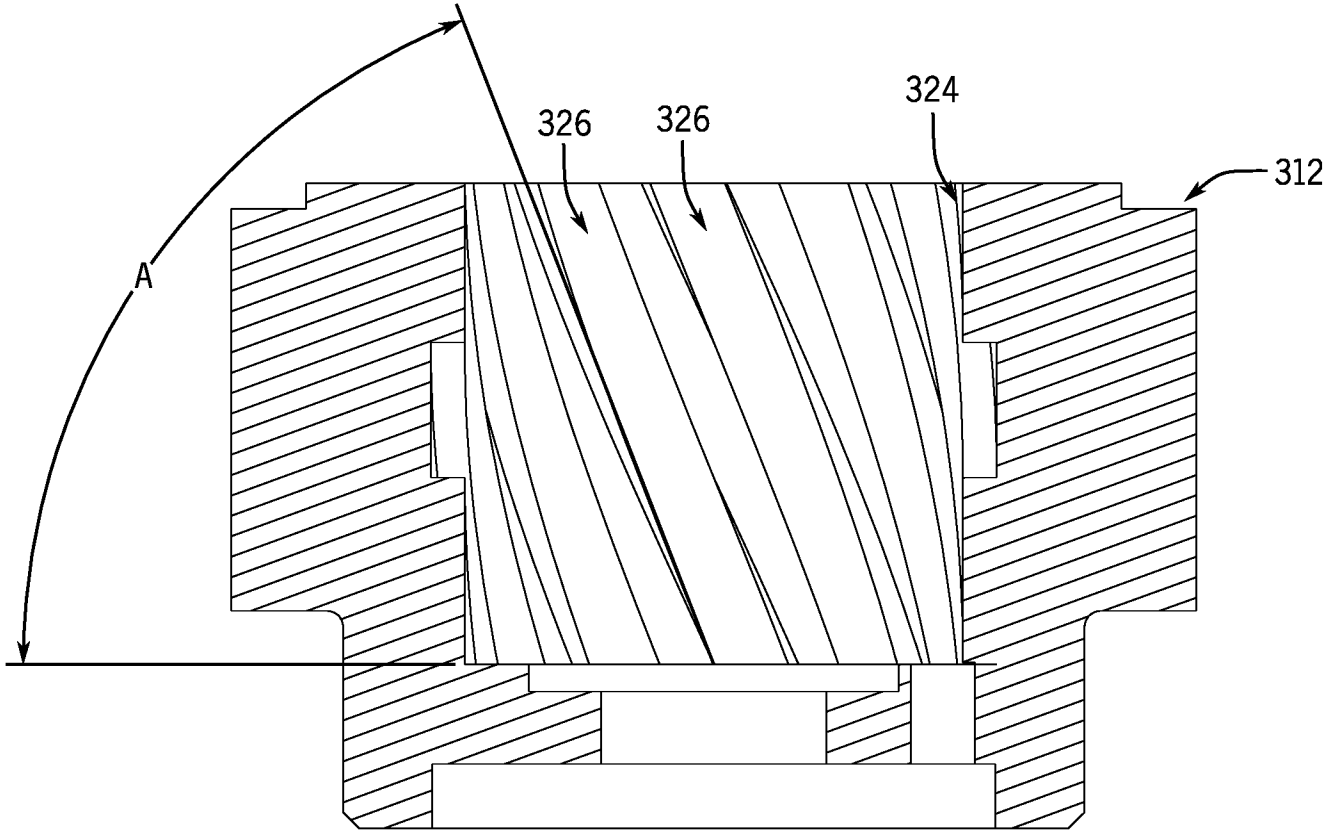
FIG. 23 is a cross-sectional view of a cradle rotor of the cam phasing system of FIG. 22 taken along line 23-23.
Figure 24:
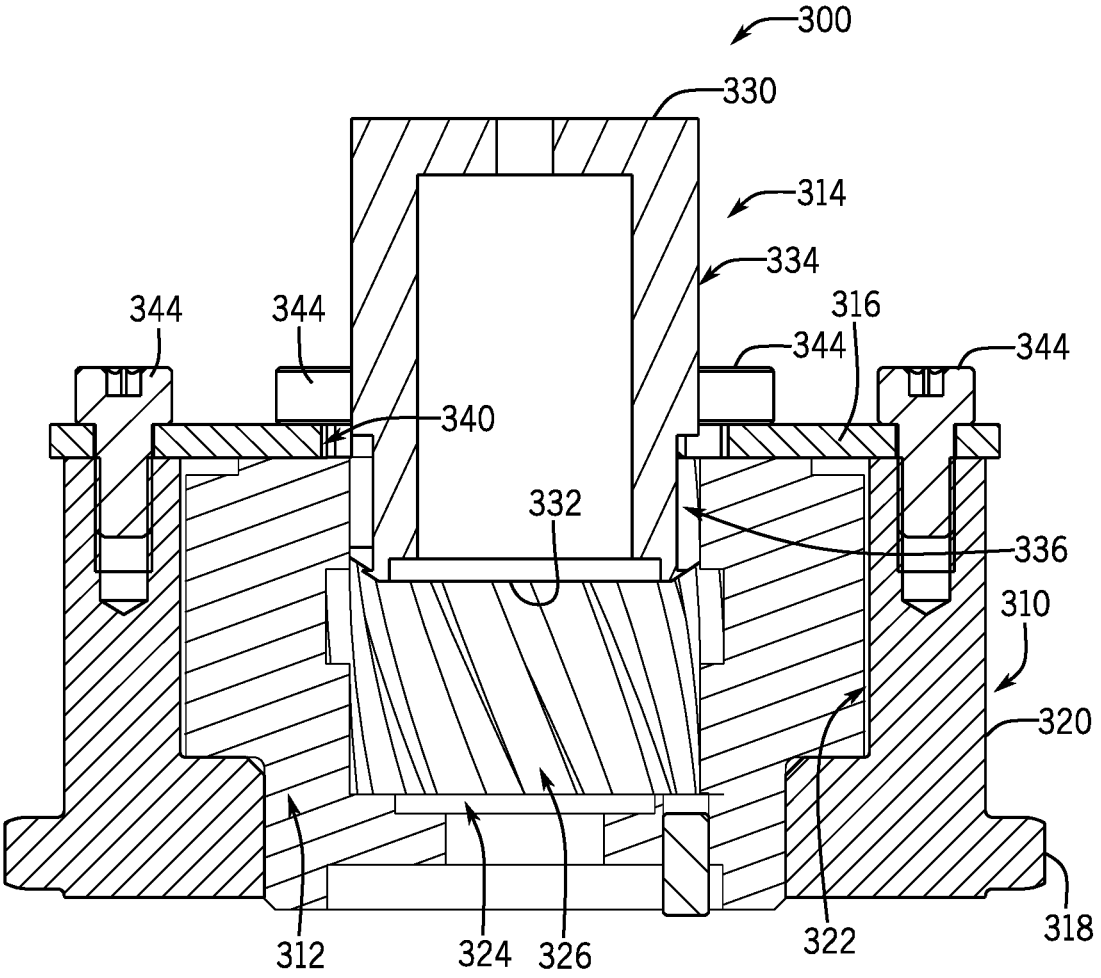
FIG. 24 is a cross-sectional view of the cam phasing system of FIG. 22 taken along line 24-24 of FIG. 22.

With specific reference to FIGS. 22-24, the sprocket hub 310 includes a gear 318 arranged around an outer surface 320 thereof, and an inner bore 322. The gear 318 may be coupled, for example, via a gear train or belt to the crankshaft of the internal combustion engine. In this way, the sprocket hub 310 may be driven to rotate at the same speed as the crankshaft. The inner bore 322 is dimensioned to receive the cradle rotor 312 therein.

The cradle rotor 312 is configured to be coupled to the camshaft of the internal combustion engine. When assembled, the cradle rotor 312 is coupled to the sprocket hub 310 for rotation therewith; however, the cradle rotor 312 is configured to selectively rotate relative to the sprocket hub 310 thereby altering the rotational relationship therebetween. The cradle rotor 312 includes an inner bore 324 having a plurality of helical features 326 formed thereon and arranged circumferentially around the inner bore 324. In the illustrated non-limiting example, the plurality of helical features 326 each define a radially recessed slot in the inner bore 324, which define a helical profile as they extend axially along the inner bore 324.

Each of the plurality of helical features 326 define a helix angle A, as shown in FIG. 8. In some non-limiting examples, the cradle rotor 312 may be designed such that the helix angle A is greater than approximately 50 degrees. In some non-limiting examples, the cradle rotor 312 may be designed such that the helix angle A is greater than approximately 60 degrees. In some non-limiting examples, the cradle rotor 312 may be designed such that the helix angle A is greater than approximately 70 degrees. In some non-limiting examples, the cradle rotor 312 may be designed such that the helix angle A is greater than approximately 80 degrees. In some non-limiting examples, the cradle rotor 312 may be designed such that the helix angle A is between approximately 50 degrees and approximately 90 degrees. In some non-limiting examples, the cradle rotor 312 may be designed such that the helix angle A is between approximately 60 degrees and approximately 90 degrees. In some non-limiting examples, the cradle rotor 312 may be designed such that the helix angle A is between approximately 70 degrees and approximately 90 degrees. In some non-limiting examples, the cradle rotor 312 may be designed such that the helix angle A is between approximately 80 degrees and approximately 90 degrees.

As will be described, the steep design of the helix angle A may frictionally lock the cradle rotor 312 and the helix rod 314 during cam torque pulses (i.e., rotational forces exerted on the cradle rotor 312 by the camshaft), thereby preventing the helix rod 314 from undesirably displacing axially relative to the cradle rotor 312.

The helix rod 314 may be configured to be coupled to the compliance mechanism 100, which is also coupled to the actuator 308. The helix rod includes a plurality of splines 328 protruding radially outward from an outer surface thereof. The plurality of splines 328 may be continuously arranged circumferentially around the helix rod 314 such that the entire circumference of the helix rod 314 is uniformly distributed with the plurality of splines 328. The plurality of splines 328 extend axially along the helix rod 314 from a first helix end 330 to a second helix end 332. Each of the plurality of splines 328 can define a linear portion 334 and a helical portion 336. The linear portions 334 extend in a direction substantially parallel to a central axis 338 from the first helix end 330 to a location between the first helix end 330 and the second helix end 332. The helical portions 336 extend in a direction generally transverse to the central axis 338 to conform to the helical pattern defined by the helical features 326 of the cradle rotor 312. The helical portions 336 extend from the location where the linear portions 334 stop to the second helix end 332. The helical portions 336 extend radially to define an increased radial thickness compared to the linear portions 334.

Each of the helical portions 336 of the helix rod 314 is configured to be received within a corresponding one of the helical features 326 in the cradle rotor 312. An interaction between the helical portions 336 of the helix rod 314 and the helical features 326 of the cradle rotor 312 enable the cradle rotor 312 to rotate relative to the sprocket hub 310 in response to an axial displacement applied by the actuator 308 and transferred thereto by the compliance mechanism 100. When assembled, the cradle rotor 312 may be constrained such that it cannot displace axially. Thus, in response to an axial displacement applied on the helix rod 314 by the actuator 308, the cradle rotor 312 is forced to rotate relative to the sprocket hub 310 due to the interaction between the helical portions 336 of the helix rod 314 and the helical features 326 of the cradle rotor 312.

As described above, the helical features 326 may be designed to define a steep helix angle A. This steep helix angle A ensures that the normal forces applied by the helical portions 336 on the helical features 326 during a rotational pulse applied on the cradle rotor 312 will be large and, therefore, the frictional forces will also be large. Since the helix angle A is designed to be large relative to the friction coefficient between the helical portions 336 and the helical features 326, rotary torque applied to the cradle rotor 312 (e.g., by the camshaft) will cause the cradle rotor 312 and the helix rod 314 to lock together. When the cradle rotor 312 and the helix rod 314 are locked during rotary torque events, axial motion of the helix rod 314 is prevented during either positive or negative torque events (depending on the actuation direction), or both. Thus, the phase may only be changed between the cradle rotor 312 and the sprocket hub 110 when the rotary torque is removed or reduced to a magnitude that allows axial motion of the helix rod 314.

The end plate 316 defines a generally annular shape and includes a central aperture 340. The central aperture 340 defines a generally spline-shaped pattern that corresponds with the linear portions 334 of the helix rod 314. That is, the central aperture 340 may include a plurality of splined protrusions 342 each extending radially inward and arranged circumferentially around the central aperture 340. The central aperture 340 is configured to receive the linear portions 334 of the helix rod 314. When assembled, the linear portions 334 of the helix rod 314 extend through the central aperture 340 and the interaction between the plurality of splines 328 on the helix rod 314 and the plurality of splined protrusions 342 on the central aperture 340 may maintain the helix rod 314 in a consistent orientation relative to the end plate 316. The end plate 316 is configured to be rigidly attached to the sprocket hub 302 such that the end plate 316 cannot rotate relative to the sprocket hub 310. In the illustrated non-limiting example, a plurality of fastening elements 344 in the form of bolts may be used to fasten the end plate 316 to the sprocket hub 310.

The design and properties of the cam phasing system 300 may enable the cradle rotor 312, and thereby the camshaft, to be rotated relative to the sprocket hub 310 over a full three-hundred and sixty degree rotational range. That is, the actuator 308 may be configured to provide an input force that may alter that rotational phase between the cradle rotor 312 and the sprocket hub 310 to be any desired relative relationship between 0 degrees and 360 degrees.

In some non-limiting examples, the helical locking leveraged by the cam phasing system 300 may be expanded into a plurality of helical sections including many different helix interfaces. In this way, for example, the cam phasing system 300 may provide a large range of relative motion between the cam coupling component 304 and the crank coupling component 302 for a relatively small amount of axial displacement. In some non-limiting examples, each of the helix interactions provided by a multi-helix design may self-lock during a torque pulse.

Figure 25:
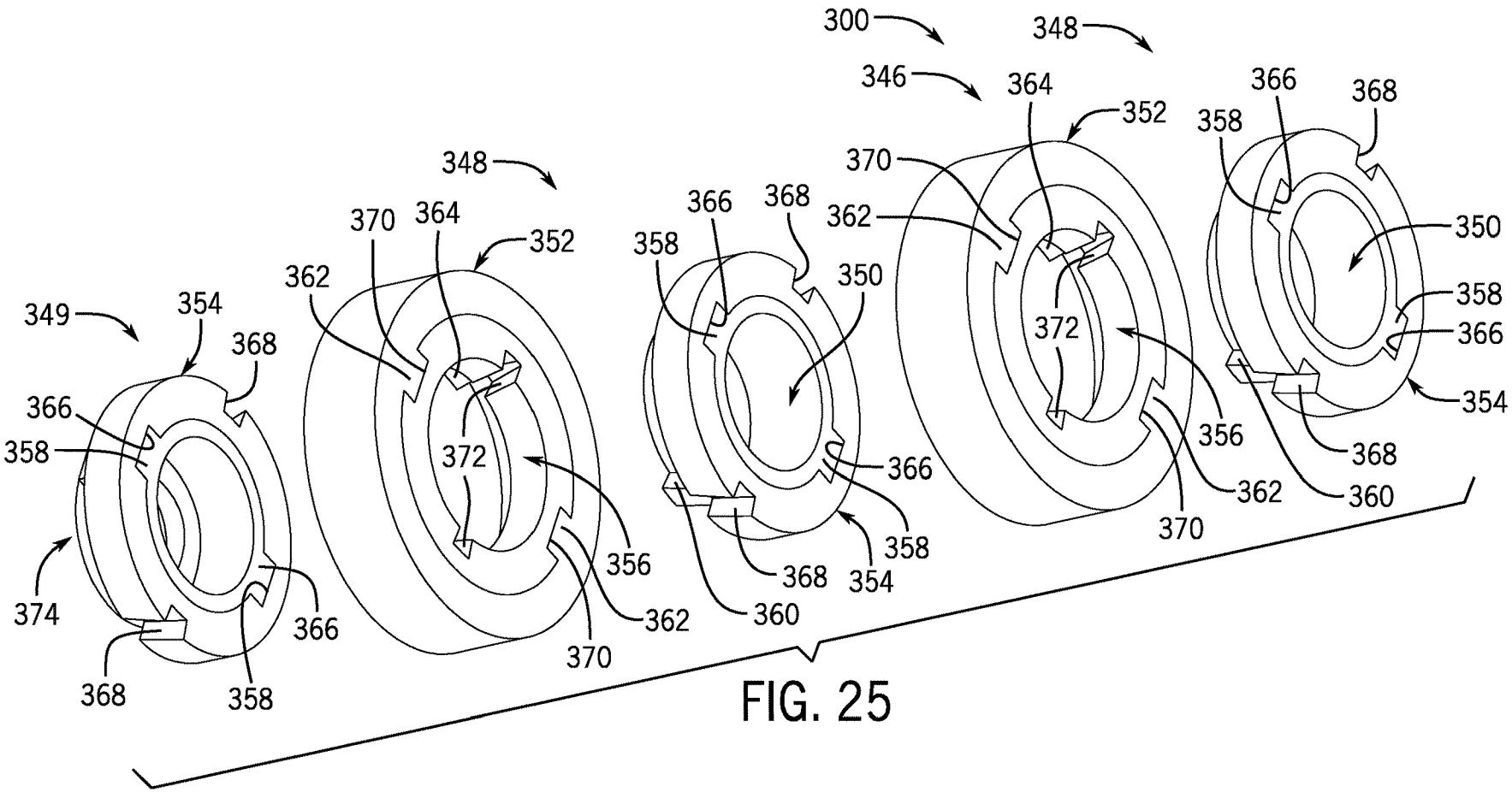
FIG. 25 is an exploded top, front, right isometric view of a cam phasing system according to another aspect of the present disclosure.
Figure 26:
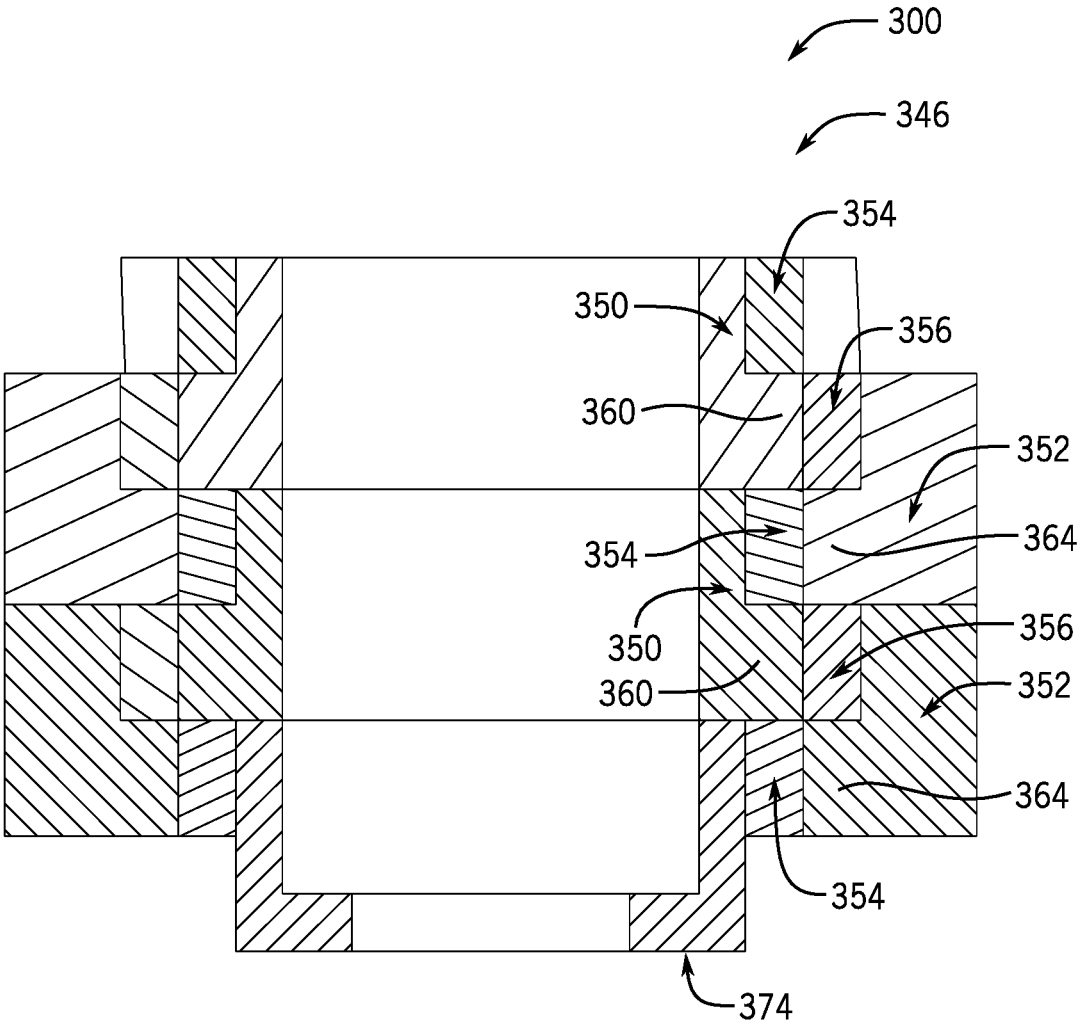
FIG. 26 is a cross-sectional view of the cam phasing system of FIG. 25.

FIGS. 25 and 26 illustrate one non-limiting example of a multi-helix design 346 that may be implemented by the cam phasing system 300. In the illustrated non-limiting example, the multi-helix design 346 includes a plurality of helix sections 348 that may be stacked axially together and coupled at one end thereof to a bottom section 349. Each of the helix sections 348 includes a cam coupling tube 350, a crank coupling tube 352, a first input ring 354, and a second input ring 356. The bottom cam coupling tube 374 may be rotationally coupled to the cam shaft of the internal combustion engine and, when assembled within the cam phasing system 300, may be inhibited from moving axially. One of the crank coupling tubes 352 may be rotationally coupled to the crank shaft of the internal combustion engine and, when assembled within the cam phasing system 300, may be inhibited from moving axially. The first input rings 354 and the second input rings 356 may be coupled to the actuator 308 (e.g., via the compliance mechanism 100) and capable of displacing axially relative to the cam coupling tubes 350 and the crank coupling tubes 352.

In the illustrated non-limiting example, each of the cam coupling tubes 350 may define a generally annular shape and includes one or more non-helical protrusions 358 arranged along a first axial location and one or more helical protrusions 360 arranged along a second axial location which does not overlap with the first axial location. The non-helical protrusions 358 and the helical protrusions 360 extend radially outward from an outer surface of the cam coupling tube 350. In addition to being axially offset, the non-helical protrusions 358 are circumferentially offset from the helical protrusions 360.

Each of the crank coupling tubes 352 may define a generally annular shape and includes one or more non-helical protrusions 362 arranged along a first axial location and one or more helical protrusions 364 arranged along a second axial location which does not overlap with the first axial location. The non-helical protrusions 362 and the helical protrusions 364 extend radially inward from an inner surface of the crank coupling tube 352. In addition to being axially offset, the non-helical protrusions 362 are circumferentially offset from the helical protrusions 364. The inner diameter of the crank coupling tubes 352 may be dimensioned to receive the cam coupling tubes 350 therein with the first input rings 354 and the second input rings 356 axially stacked and arranged radially between the crank coupling tubes 352 and the cam coupling tubes 350.

Each of the first input rings 354 defines a generally annular shape and includes one or more non-helical recesses 366 recessed radially into an inner surface thereof and one or more helical recesses 368 recessed radially into an outer surface thereof. The one or more non-helical recesses 366 are configured to receive the one or more non-helical protrusions 358 of the cam coupling tubes 350. The one or more helical recesses 368 are configured to receive the one or more helical protrusions 364 of the crank coupling tubes 352.

Each of the second input rings 356 defines a generally annular shape and includes one or more non-helical recesses 370 recessed radially into an outer surface thereof and one or more helical recesses 372 recessed radially into an inner surface thereof. The one or more non-helical recesses 370 are configured to receive the one or more non-helical protrusions 362 of the crank coupling tubes 352. The one or more helical recesses 372 are configured to receive the one or more helical protrusions 360 of the cam coupling tubes 350.

When assembled, the first input rings 354 and the second input rings 365 may be alternatingly stacked axially and arranged radially between the inner surface of the crank coupling component 352 and the outer surface of the cam coupling component 350. Each of the cam coupling tubes 350 defines a helical interaction with a corresponding one of the second input rings 356, and each of the crank coupling tubes 352 defines a helical interaction with a corresponding one of the first input rings 354. The helical interactions of the crank coupling tube 352 are arranged radially outward and axially offset from the helical interactions of the cam coupling tube 354.

The bottom section 349 may include a bottom cam coupling tube 374 and one of the first input rings 354 coupled thereto. The bottom cam coupling tube 374 may be similar to the cam coupling tubes 350, but may not include the one or more helical protrusions 360. The bottom cam coupling tube 374 may be directly or indirectly coupled to the cam shaft of the internal combustion engine.

In operation, each of the first input rings 354 may be prevented from rotating relative to the cam coupling tubes 350, 374 due to the interaction between the non-helical recesses 366 and the non-helical protrusions 358. Similarly, each of the second input rings 356 may be prevented from rotating relative to the crank coupling tubes 352 due to the interaction between the non-helical recesses 370 and the non-helical protrusions 362. The cam coupling tubes 350, 374 and the crank coupling tubes 352 are each allowed to rotate with respect to one another. If it is desired to alter a rotational relationship between the cam shaft and the crank shaft on the internal combustion engine, the actuator 308 may apply an input force to the stack of the first and second input tubes 354 and 356. In response, the first and second input tubes 354 and 356 may translate axially a desired amount. Since the first input tubes 354 are prevented from rotating relative to the cam coupling tubes 350, 374, and the second input tubes 356 are prevented from rotating relative to the crank coupling tubes 352, the helical interactions between the first and second input tubes 354 and 356 and the cam and crank coupling tubes 350 and 352 may result in the cam coupling tubes 350 rotating a desired amount (governed by the input force provided by the actuator 308) relative to the crank coupling tubes 352. The use of multiple helix sections 348, 349 with a plurality of helical interactions may enable the cam phasing system 300 to provide a relatively large rotational displacement in response to a small axial displacement applied thereto, while also maintaining a high helix angle for the helical interactions to facilitate better helix locking (e.g., frictional locking).

In some non-limiting examples, the cam phasing system 300 may also be designed so that the steep helix angle A transfers rotary torque applied to the cradle rotor 312 into axial force applied to the helix rod 314. In this case, even if the friction coefficient between the helical portions 336 and the helical features 326 is not sufficient to fully lock the system, the large rotary torques are transferred into an axial force that is easily supported by an external force. That is, the helix rod 314 may be coupled to an input unit that is configured to support this external force, thereby enabling control of the relative rotational position of the cradle rotor 312. The input unit may be configured to selectively support the external force. When the input unit supports the external force, axial motion of the helix rod 314 may be prevented and the system may be locked. Alternatively or additionally, the input unit may support the external force such that the helix rod 314 may be allowed to displace axially, thereby altering the relative rotational position of the cradle rotor 312.

Figure 27:
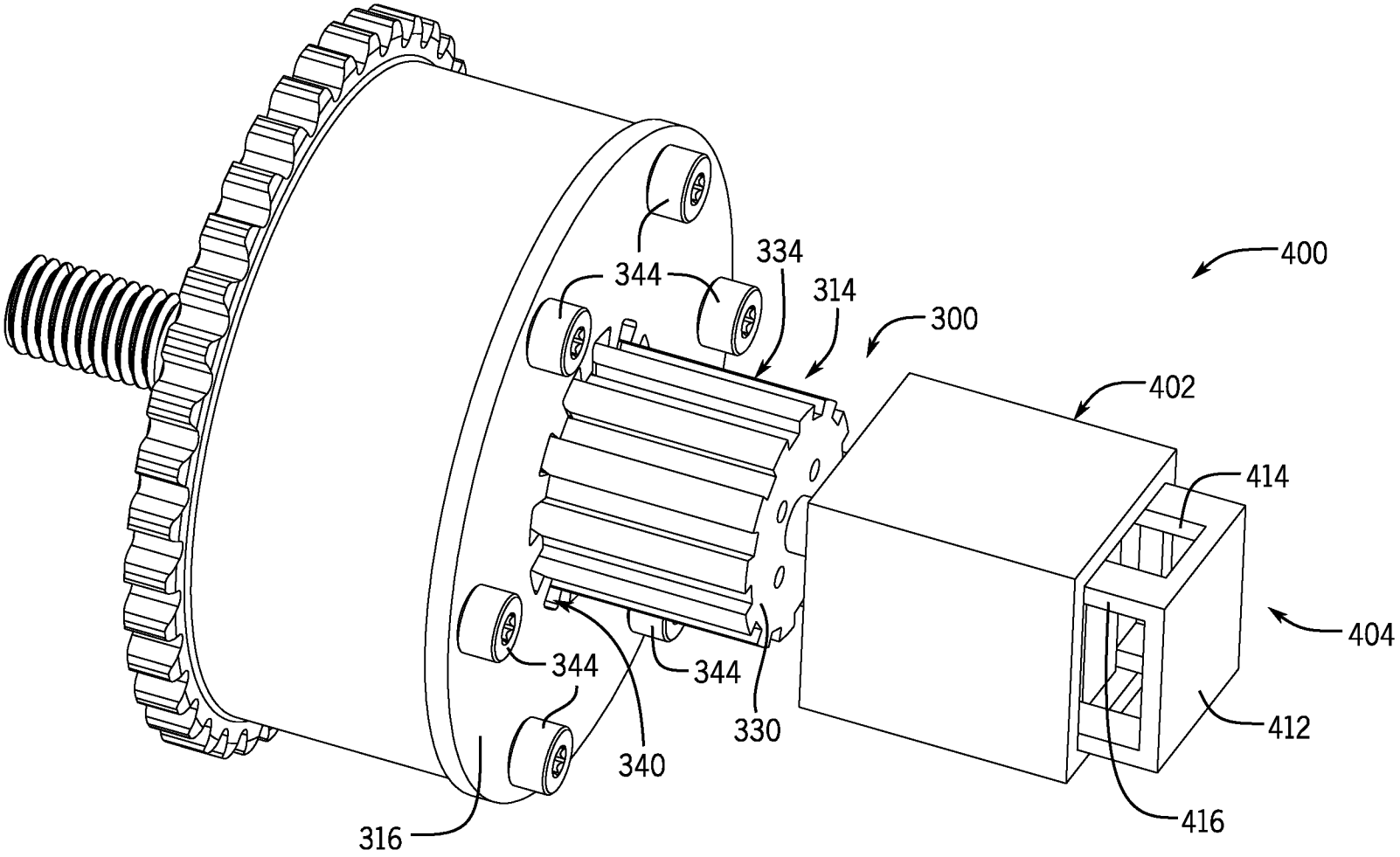
FIG. 27 is a top, front, right isometric view of the cam phasing system of FIG. 22 with an external linear clutch.
Figure 28:
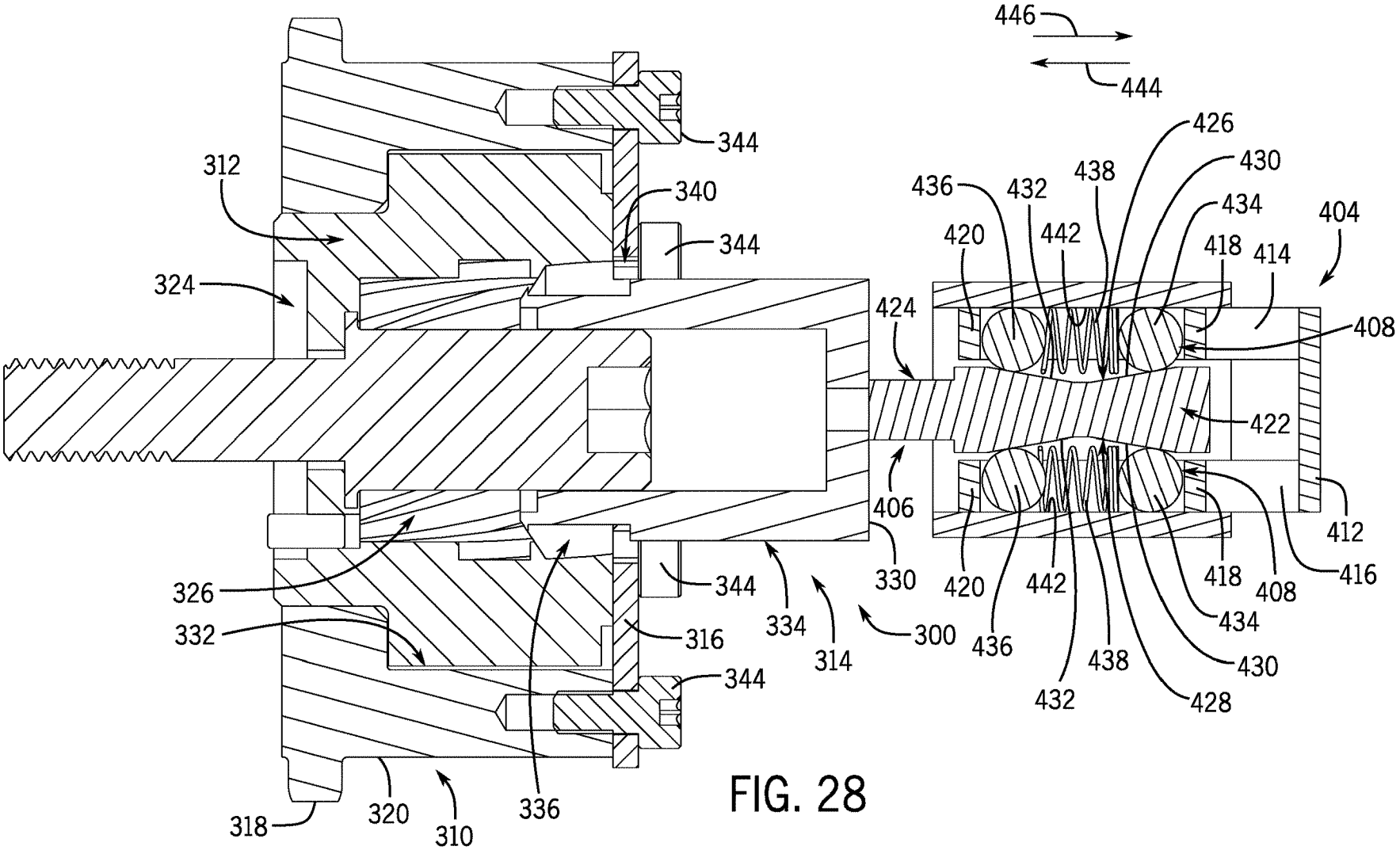
FIG. 28 is a cross-sectional view of the cam phasing system of FIG. 27 taken along line 28-28.
Figure 29:
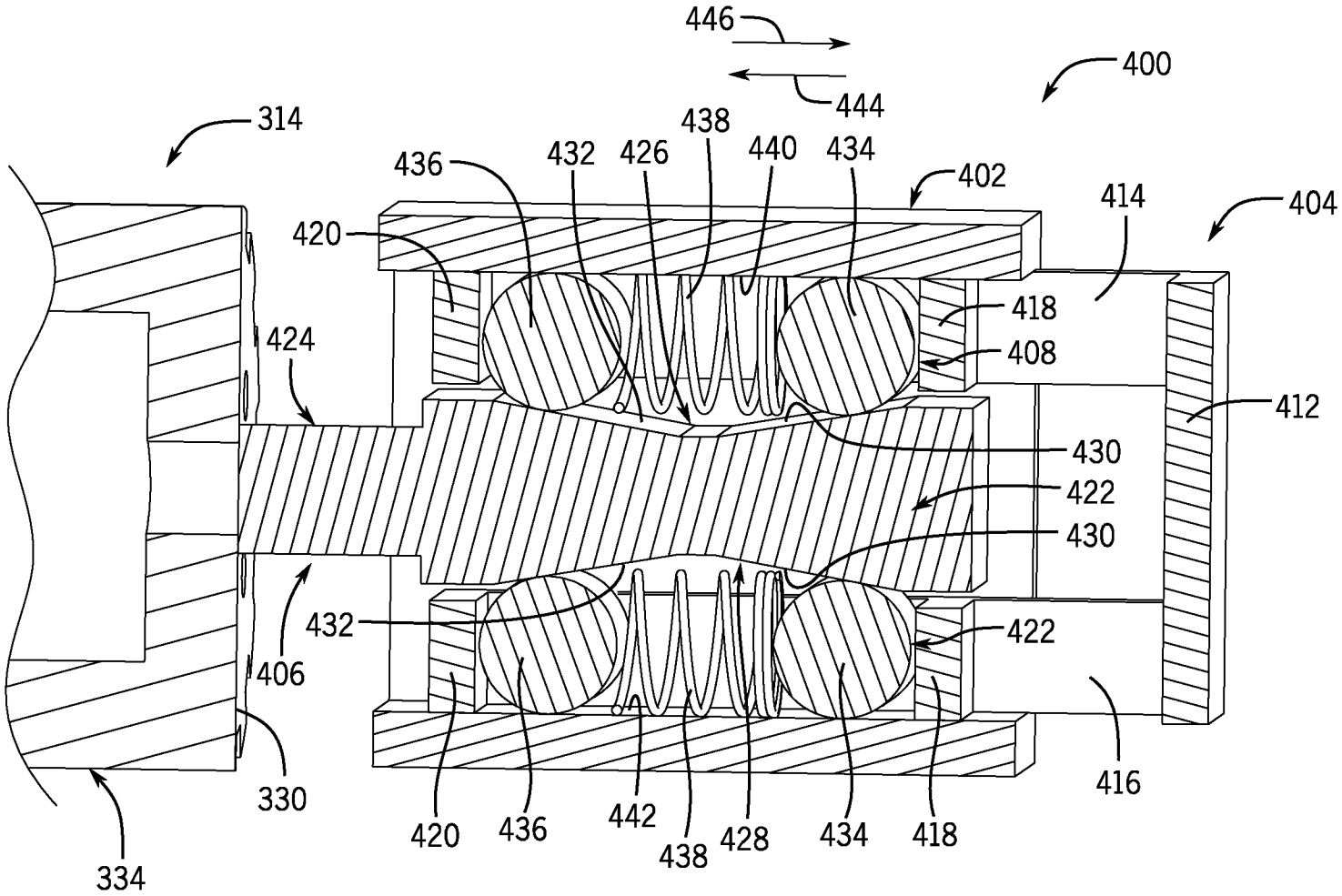
FIG. 29 is an enlarged view of the linear clutch of FIG. 28.

FIGS. 27-29 illustrate one non-limiting example of an input unit in the form of a linear clutch 400 that may be integrated into the cam phasing system 300. In some non-limiting examples, the linear clutch 400 may receive an input force from the actuator 308 and, depending on the direction of the input force, the linear clutch 400 may be configured to support linear forces applied to the input component 306, for example, resulting from cam torque pulses applied to the cam coupling component 304, and thereby inhibit movement of the input component 306 in a direction opposite to a desired direction. Thus, the linear clutch 400 may be configured to lock the motion of the input component 306, for example, during cam torque pulse events occurring in a direction opposite to a desired direction, and only allow the input component 306 to move in a direction that corresponds with the cam coupling component 302 moving in the desired direction In the illustrated non-limiting example, the linear clutch 400 includes a housing 402, a push rod 404, a following rod 406, and a one or more of locking assemblies 408. In the illustrated non-limiting example, the housing 402 defines a generally rectangular shape. In other non-limiting examples, the housing may define another shape (e.g., circular, polygonal, etc.), as desired. The housing 402 is generally hollow and defines an interior cavity 410 within which the push rod 404 and the following rod 406 may be at least partially received and the one or more locking assemblies 408 may be enclosed. The push rod 404, the following rod 406, and the one or more locking assemblies may be moveable relative to the housing 402.

The push rod 404 includes an actuator platform 412, a first pair of connecting arms 414, a second pair of connecting arms 416, a first pair of input arms 418, and a second pair of input arms 420. The actuator platform 412 is arranged externally from the housing 402 and is configured to be coupled to the actuator 308. The first and second pair of connecting arms 414 and 416 extend from the actuator platform 412 into the interior cavity 410 of the housing 402. The first and second pair of connecting arms 414 and 416 can be spaced apart laterally such that at least at portion of the following rod 406 may be arranged therebetween. The first pair of connecting arms 414 are spaced apart from one another to allow one of the one or more locking assemblies 408 to be arranged therebetween. The second pair of connecting arms 416 are spaced apart from one another to allow another of the one or more locking assemblies 408 to be arranged therebetween.

One of the first pair of input arms 418 extends laterally between the first pair of connecting arms 414, and the other of the first pair of input arms 418 extends laterally between the second pair of connecting arms 416. The first pair of input arms 418 are arranged on one side of the one or more locking assemblies 408 arranged within the interior cavity 410 of the housing 402. One of the second pair of input arms 420 extends laterally between the first pair of connecting arms 414, and the other of the second pair of input arms 420 extends laterally between the second pair of input arms 420. The second pair of input arms 420 are spaced from the first pair of input arms 418 and are arranged on an opposing side of the one or more locking assemblies 408 arranged within the interior cavity 410 of the housing 402. In general, the first pair of connecting arms 414 in combination with the first input arm 418 and the second input arm 420 extending laterally therebetween surround one of the one or more locking assemblies 408. The second pair of connecting arms 416 in combination with the first input arm 418 and the second input arm 420 extending laterally therebetween generally surround another of the one or more locking assemblies 408.

In the illustrated non-limiting example, the following rod 406 includes a locking portion 422 and a coupling portion 424. The locking portion 422 is generally arranged within the interior cavity 410 of the housing 402 and is arranged between the first and second pairs of connecting arms 414 and 416 and between the one or more locking assemblies 408. The locking portion 422 includes a first side 426 and a second side 428. The first side 426 of the locking portion 422 includes one of a pair of first tapered surfaces 430 and one of a pair of second tapered surfaces 432 arranged thereon. The second side 428 of the locking portion 422 includes another of the pair of first tapered surfaces 430 and another of the pair of second tapered surfaces 432 arranged thereon. On each side of the locking portion 422, the first tapered surfaces 430 and the second tapered surface 432 taper as they extend toward one another. That is, the first tapered surface 430 slopes inward toward a centerline of the following rod 406 as it extends in a direction toward the second tapered surface 432, and the second tapered surface 432 slopes inward toward the centerline of the following rod 406 as it extends in a direction toward the first tapered surfaces 430. In this way, the first tapered surface 430 and the second tapered surface 432 form a generally V-shaped profile on each of the first side 426 and the second side 428 of the locking portion 422.

The coupling portion 424 extends from an end of the locking portion 422 arranged adjacent to the input component 306 (e.g., the helix rod 314). The coupling portion 424 generally defines a rod-like shape and is configured to be coupled to the input component 306 (e.g., the helix rod 314) such that axial movement (i.e., non-rotational displacement) can be transferred between the following rod 406 and the input component 306 (e.g., the helix rod 314). In some non-limiting examples, the push-pull coupling 10 may be implemented to provide a coupling between the input component 306 (e.g., the helix rod 314) and the coupling portion 424.

In the illustrated non-limiting example, the linear clutch 400 includes two locking assemblies 408 arranged within the interior cavity 410 of the housing 402. In other non-limiting examples, the linear clutch 400 may include more or less than two locking assemblies 408 and the push rod 402 and following rod 406 may be designed to accordingly to accommodate any number of locking assemblies 408. Each of the locking assemblies 408 includes a first locking member 434, a second locking member 436, and a biasing element 438 arranged between the first locking member 434 and the second locking member 436. In the illustrated non-limiting example, the first locking members 434 and the second locking members 436 are in the form of roller bearings. In other non-limiting examples, the first locking members 434 and the second locking members 436 may be in the form of wedges. The biasing element 438 biases the first locking members 434 and the second locking members 436 away from one another. When assembled, the biasing elements 438 may bias the first locking members 434 toward the first input arms 418 and the second locking members 436 toward the second input arms 420.

In operation, the housing 402 is rotationally fixed to a stationary datum and, therefore, does not rotate with the helix rod 314 and the other rotating components within the cam phasing system 300. In an initial state, with no input force applied by the actuator 308 to the push rod 404, the biasing elements 438 may wedge the first locking members 434 and the second locking members 436 between mating surfaces, thereby preventing the axial displacement of the helix rod 314. Specifically, one of the first locking members 434 may be wedged between the first tapered surface 430 on the first side 426 of the locking portion 422 and a first inner surface 440 of the housing 402 and another of the first locking members 434 may be wedged between the first tapered surface 430 on the second side 428 of the locking portion 422 and a second inner surface 442 of the housing 402. In addition, one of the second locking members 436 may be wedged between the second tapered surface 432 on the first side 426 of the locking portion 422 and the first inner surface 440 of the housing 402 and another of the second locking members 436 may be wedged between the second tapered surface 432 on the second side 428 of the locking portion 422 and the second inner surface 442 of the housing 402. In this wedged condition, the first locking members 434 and the second locking members 436 may be in a locked state in which displacement of the following rod 406 is inhibited. Since the following rod 406 is coupled to the helix rod 314, the helix rod 314 may also be prevented from displacing axially, when the first and second locking members 434 and the second locking members 436 are in the locked state. In this way, for example, the linear clutch 400 may prevent cam torque pulses in either a clockwise or counterclockwise direction that act on the cradle rotor 312 from axially displacing the helix rod 314, when the first locking members 436 and the second locking members 436 are in the locked state.

If it is desired to alter the rotational phase between the cradle rotor 312 and the sprocket hub 310, the actuator 308 may apply a input force (e.g., a linear force) in a desired direction to the actuator platform 412 of the push rod 404 to displace the push rod 404 a desired distance in the desired direction. In some non-limiting examples, the compliance mechanism 100 may be arranged between the actuator 308 and the linear clutch 400. The amount that the push rod 404 is displaced by the actuator 308 directly corresponds with an amount of rotational phasing desired between the cradle rotor 312 and the sprocket hub 310. In one non-limiting example, the actuator 308 may apply an input force in a first direction 444. Displacement of the actuator in the first direction 444 may displace the first pair of input arms 418 into engagement with the first locking members 434, such that the first locking members 434 move out of engagement with the inner surfaces 440, 442 of the housing 402 or the first tapered surfaces 430. Thus, in response to the input force in the first direction 444, the first locking members 434 may be biased into an unlocked state.

With the first locking members 434 in the unlocked state, the linear clutch 400 may allow the helix rod 314 to axially displace in the first direction 444. At the same time, the biasing element 438 may maintain the second locking members 436 in the locked state. Thus, the linear clutch 400 may prevent the helix rod 314 from axially displacing in a second direction 446 opposite to the first direction 444. For example, the linear clutch 400 may linearly support the helix rod 314 during cam torque pulses applied to the cradle rotor 312 that attempt to axially displace the helix rod 314 in the second direction 446. As such, with the input force applied in the first direction 444, the linear clutch 400 may only allow the helix rod 314 to axially displace in the first direction 444 to achieve the desired rotational relationship between the cradle rotor 312 and the sprocket hub 310.

As the helix rod 314 is allowed to move axially in the first direction 444, the following rod 406 coupled thereto displaces with the helix rod 314. The helix rod 314 will be allowed to axially displace in the first direction 444 until the following rod 406 displaces in accordance with the amount of displacement applied to the push rod 404 by the actuator 308 and again places the first locking members 434 into the wedged, locked state. It should be appreciated that the opposite functionality may be provided by the linear clutch 400 in response to an input force in the second direction 446 applied to the push rod 404 by the actuator 308.

Figure 30:
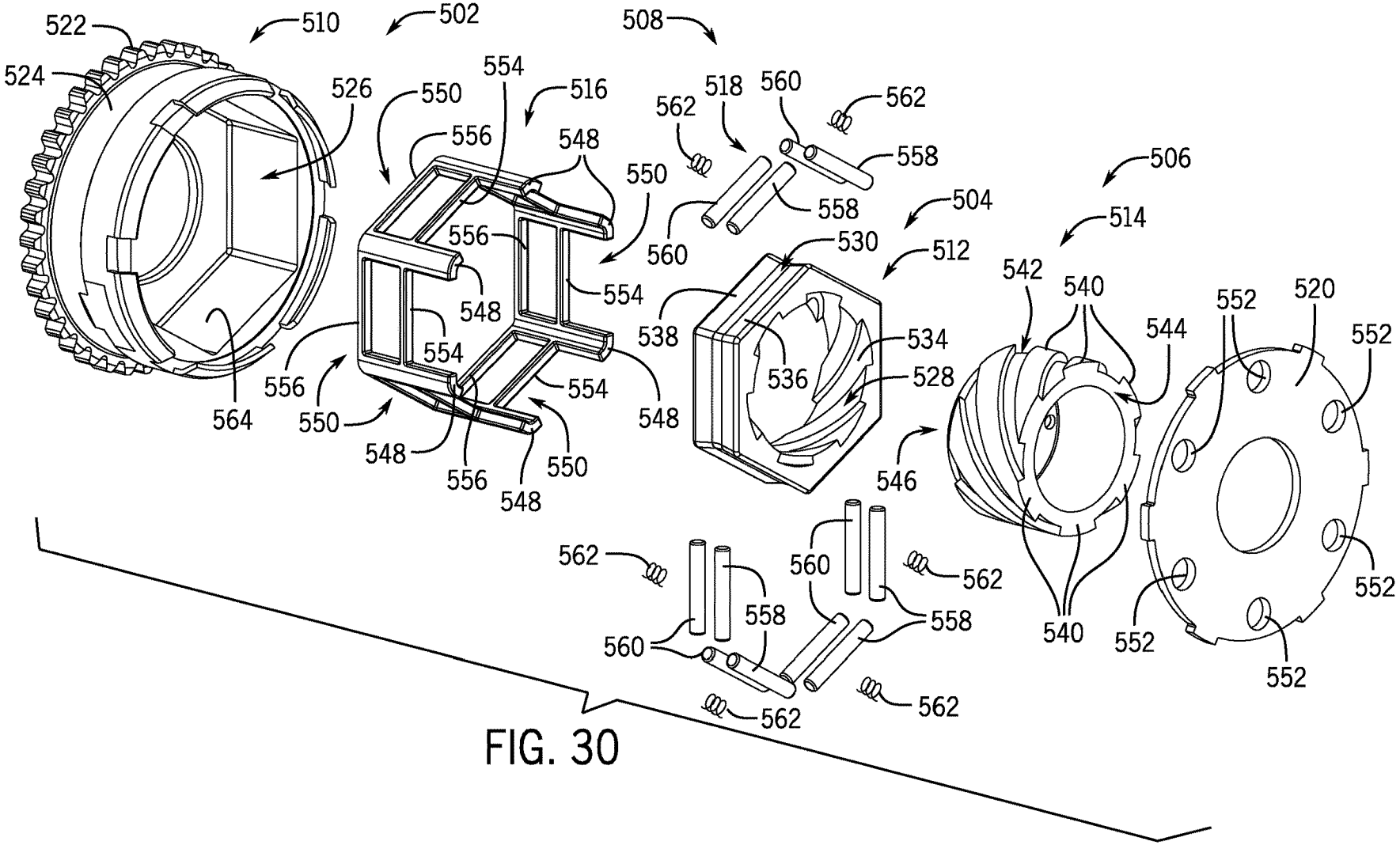
FIG. 30 is an exploded top, front, right isometric view of a cam phasing system according to another aspect of the present disclosure.
Figure 31:
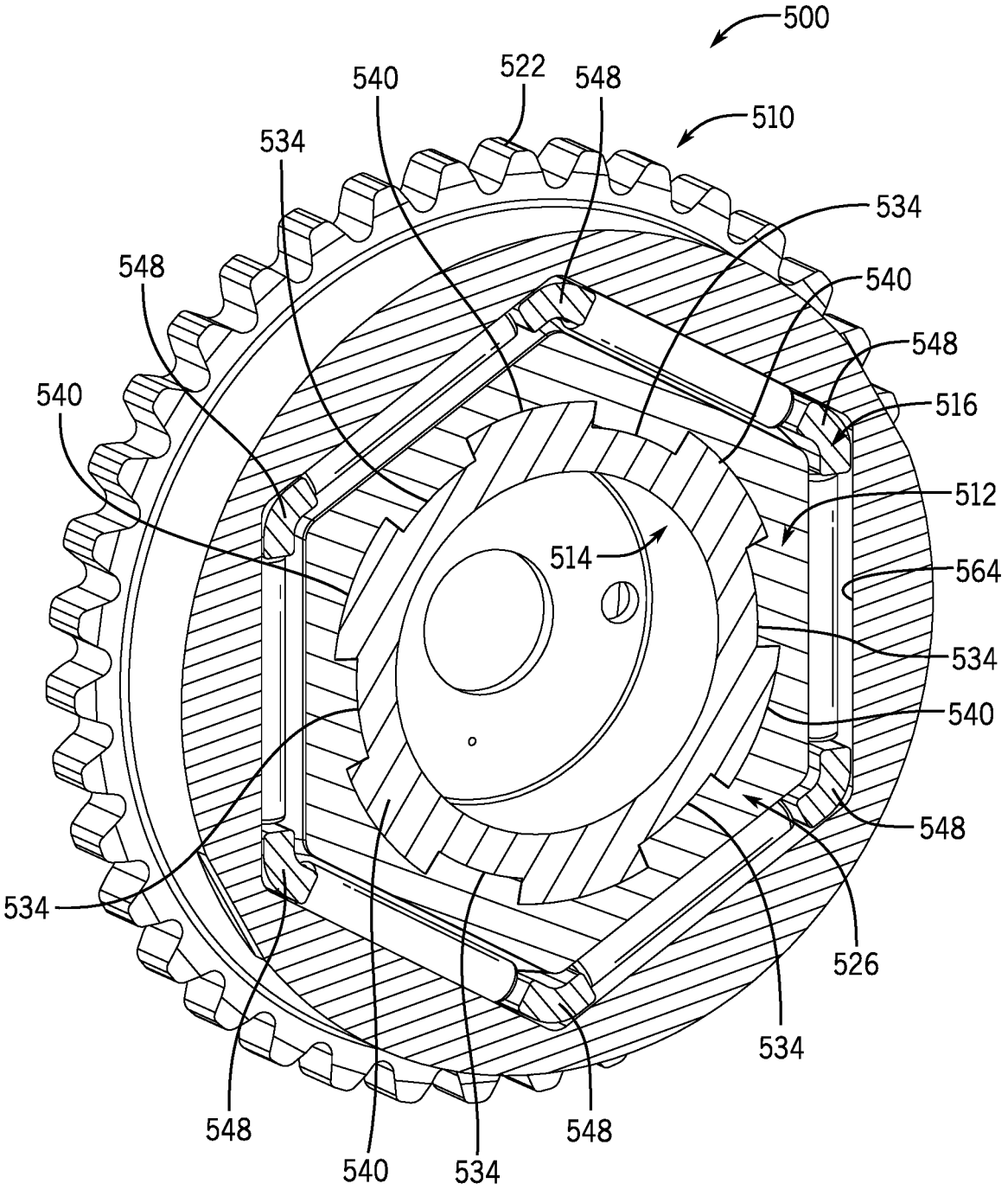
FIG. 31 is a top front, right isometric view of the cam phasing system of FIG. 30 with an end plate removed.
Figure 32:
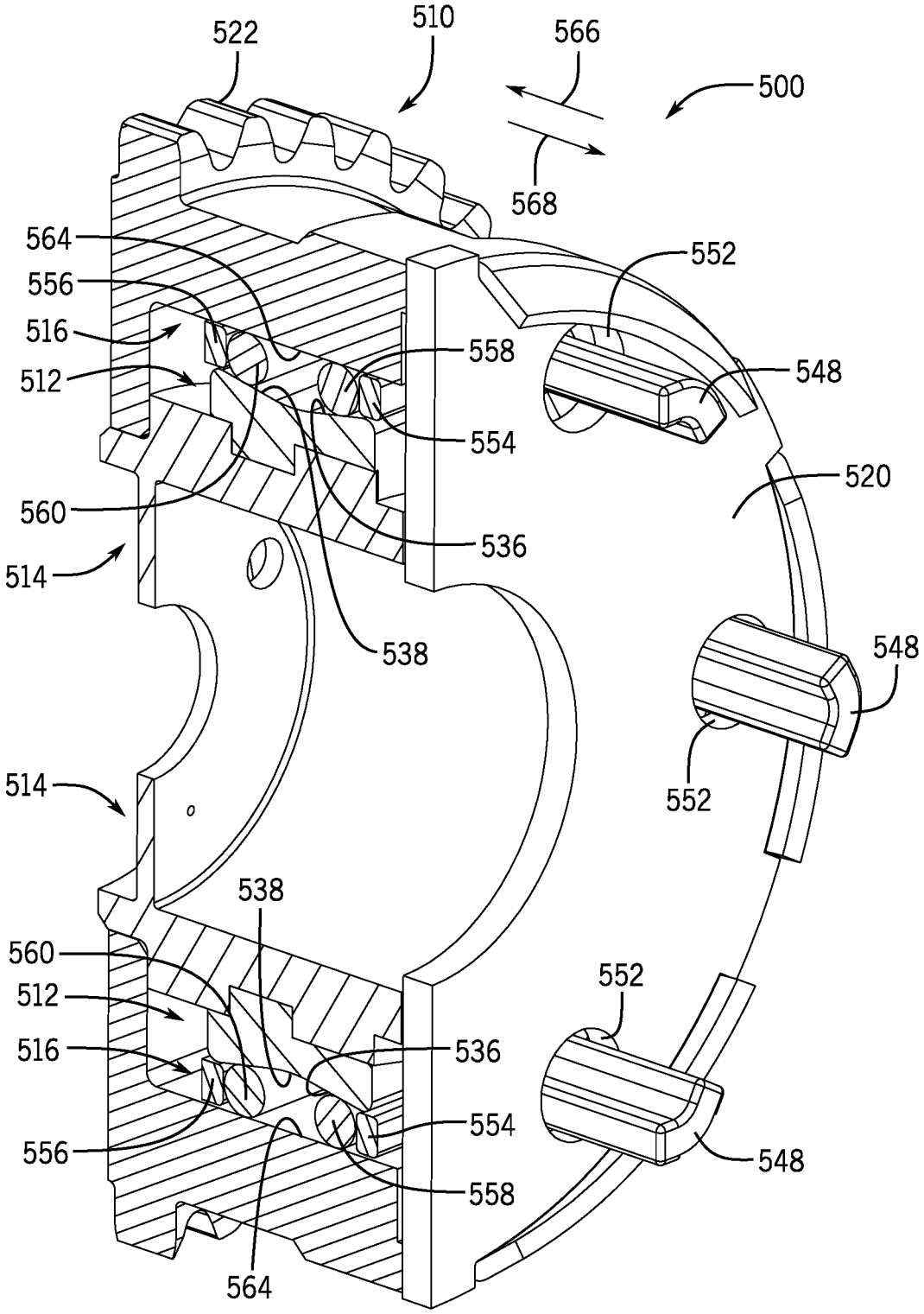
FIG. 32 is a cross-sectional view of the cam phasing system of FIG. 30.

In some non-limiting examples, the design and properties of the linear clutch 400 described herein may be integrated into or arranged internally within a cam phasing system. FIGS. 30-32 illustrate one non-limiting example of a cam phasing system 500 that includes an internal linear clutch according to the present disclosure. In general, the cam phasing system 500 may include a crank coupling component 502, a cam coupling component 506, an input component 504, and a linear clutch 508. The crank coupling component 502 is configured to be coupled (e.g., via a gear train or a belt) to a crankshaft (not shown) of an internal combustion engine. The cam coupling component 506 is configured to be coupled to the crank coupling component 502 and to a camshaft (not shown) of the internal combustion engine. Thus, the cam phasing system 500 is configured to be coupled to the camshaft and the crankshaft of the internal combustion engine to enable the relative relationship (i.e., the phase angle) to be altered therebetween.

In the illustrated non-limiting example, the crank coupling component 502 may be in the form of a sprocket hub 510, and the cam coupling component 506 may be in the form of a cradle rotor 514. The input component 504 may be in the form of a helix rotor 512. The linear clutch 508 may be formed by a spider rotor 516 and a plurality of locking assemblies 518. In the illustrated non-limiting example, the cam phasing system 500 may also include an end plate 520.

The sprocket hub 510 includes a gear 522 arranged around an outer surface 524 thereof, and an inner bore 526. The gear 522 may be coupled, for example, via a gear train or belt to the crankshaft of the internal combustion engine. In this way, the sprocket hub 510 may be driven to rotate at the same speed as the crankshaft. The inner bore 526 is dimensioned to receive the cradle rotor 514, the helix rotor 512, at least a portion of the spider rotor 516, and the locking assemblies 518 therein.

The helix rotor 512 includes an inner bore 528 and an outer surface 530. The inner bore 528 includes having a plurality of helical features 534 formed thereon and arranged circumferentially around the inner bore 528. In the illustrated non-limiting example, the plurality of helical features 534 each define a radially recessed slot in the inner bore 528, which define a helical profile as they extend axially along the inner bore 528.

The outer surface 530 of the helix rotor 512 includes a first tapered portion 536 and second tapered portion 538 arranged thereon. The first tapered portion 536 and the second tapered portion 538 taper as they extend toward one another. That is, the first tapered portion 536 slopes inward toward a center axis of the helix rotor 512 as it extends in a direction toward the second tapered portion 538, and the second tapered portion 538 slopes inward toward the center axis of the helix rotor 512 as it extends in a direction toward the first tapered portion 536. In this way, the first tapered portion 536 and the second tapered portion 538 form a generally V-shaped profile on the outer surface 530 of the helix rotor 512.

The cradle rotor 514 is configured to be coupled to the camshaft of the internal combustion engine. When assembled, the cradle rotor 514 is coupled to the sprocket hub 510 for rotation therewith; however, the cradle rotor 514 is configured to selectively rotate relative to the sprocket hub 510 thereby altering the rotational relationship therebetween. The cradle rotor 514 includes a plurality of splines 540 protruding radially outward from an outer surface 542 thereof. The plurality of splines 540 may be continuously arranged circumferentially around the cradle rotor 514 such that the entire circumference of the cradle rotor 514 is uniformly distributed with the plurality of splines 540. The plurality of splines 540 extend axially along the cradle rotor 514 from a first helix end 544 to a second helix end 546. Each of the plurality of splines 540 can extend axially between the first helix end 544 and the second helix end 546 in a helical pattern that conforms to the helical pattern defined by the helical features 534 of the helix rotor 512.

Each of the splines 540 of the cradle rotor 514 is configured to be received within a corresponding one of the helical features 534 in the helix rotor 512. An interaction between the splines 540 of the cradle rotor 514 and the helical features 534 of the helix rotor 512 enable the cradle rotor 512 to rotate relative to the sprocket hub 510 in response to an axial displacement applied by an actuator and transferred to the helix rotor 512 by the linear clutch 508. In some non-limiting examples, the compliance mechanism 100 may be arranged between an actuator and the linear clutch 508. When assembled, the cradle rotor 514 may be constrained such that it cannot displace axially. For example, the cradle rotor 514 may be axially constrained within the inner bore 526 of the sprocket hub 510 and secured therein by the end plate 520. Thus, in response to an axial displacement applied on the helix rotor 512 by the linear clutch 508, the cradle rotor 514 is forced to rotate relative to the sprocket hub 510 due to the interaction between the splines 540 of the cradle rotor 514 and the helical features 534 of the helix rotor 512.

In the illustrated non-limiting example, the spider rotor 516 defines a generally annular shape with a hexagonal outline that conforms to a shape of the inner bore 526 of the sprocket hub 510. In this way, for example, the geometry defined by the inner bore 526 of the sprocket hub 510 and the corresponding geometry of the spider rotor 516 may prevent relative rotation between the spider rotor 516 and the sprocket hub 510. In some non-limiting examples, the inner bore 526 of the sprocket hub 510 and the spider rotor 516 may define another geometry that prevents relative rotation therebetween (e.g., rectangular, pentagonal, polygonal, elliptical, etc.). In some non-limiting examples, the inner bore 526 of the sprocket hub 510 and the spider rotor 516 may be prevented from rotating relative to one another via another mechanism (e.g., a pin, a keyed feature, etc.), rather than geometrically.

The spider rotor 516 includes a plurality of actuation arms 548 extending axially from a periphery thereof and a plurality of locking cages 550 arranged between sequential pairs of the actuation arms 548. The actuation arms 548 are arranged circumferentially around the spider rotor 516 and, when assembled, extend axially toward the end plate 420. The end plate 420 includes a plurality of actuation apertures 552 arranged circumferentially around and adjacent to a periphery thereof. Each of the actuation apertures 552 is configured to receive a corresponding one of the actuation arms 548 therethrough. Thus, the actuation arms 548 extend axially past the end plate 520 to facilitate the coupling of an actuator thereto.

Each of the locking cages 550 is formed by a first input arm 554 and a second input arm 556 that are spaced axially from one another and extend laterally between a corresponding pair of the actuation arms 548. The first input arms 554 and the second input arms 556 are spaced axially to facilitate the locking assemblies 518 to be arranged therebetween.

In the illustrated non-limiting example, the linear clutch 508 includes six locking assemblies 518, which conforms to the generally hexagonal shape defined by the outer surface of the outer surface 530 of the helix rotor 512 (and the inner bore 526 and the spider rotor 516). In other non-limiting examples, the linear clutch 508 may include more or less than six locking assemblies 508 and to conform to alternative shapes of the inner bore 526, the spider rotor 516 and the outer surface 530.

Each of the locking assemblies 518 includes a first locking member 558, a second locking member 560, and a biasing element 562 arranged between the first locking member 558 and the second locking member 560. In the illustrated non-limiting example, the first locking members 558 and the second locking members 560 are in the form of roller bearings. In other non-limiting examples, the first locking members 558 and the second locking members 560 may be in the form of wedges. The biasing element 562 biases the first locking members 558 and the second locking members 560 away from one another. When assembled, the biasing elements 562 may bias the first locking members 558 toward the first input arms 554 and the second locking members 560 toward the second input arms 556.

With the linear clutch 508, the helix rotor 512, and the cradle rotor 514 installed into the inner bore 526 of the sprocket hub 510 (see, e.g., FIG. 32), the locking assemblies 508 may be arranged axially between the first input arms 554 and the second input arms 556 and may be radially wedged between the outer surface 530 of the helix rotor 512 and the inner surface 564 of the sprocket hub 510. Specifically, the biasing elements 562 may wedge the first locking members 558 between the first tapered surface 536 and the inner surface 564 of the sprocket hub 510, and wedge the second locking members 560 between the second tapered surface 538 and the inner surface 564 of the sprocket hub 510. Thus, the locking assemblies 518 may be radially wedged between the outer surface 530 of the helix rotor 512 and the inner surface 564 of the sprocket hub 510 in a free state (i.e., with no input force applied to the spider rotor 516). In this way, for example, the locking assemblies 518 may prevent the helix rotor 512 being able to rotate relative to the cradle rotor 514. In addition, in the free state, the first locking members 558 and the second locking members 556 may be in a locked state where axial translation of the helix rotor 512 is inhibited due to the wedged arrangement of the locked state. Thus, the linear clutch 508 may prevent cam torque pulses in either a clockwise or counterclockwise direction that act on the cradle rotor 514 from axially displacing the helix rotor 512, when the first locking members 558 and the second locking members 556 are in the locked state. In other words, in free state, the linear clutch 508 may support linear, or axial, forces applied thereto as a result of cam torque pulses acting on the cradle rotor 514 and maintain the rotational orientation of the cradle rotor 514 relative to the sprocket hub 510.

If it is desired to alter the rotational phase between the cradle rotor 514 and the sprocket hub 510, an actuator may apply a input force (e.g., a linear force) in a desired direction to the actuation arms 548 of the spider rotor 516 to displace the spider rotor 516 a desired distance in the desired direction. In some non-limiting examples, the actuator may apply an input displacement to the compliance mechanism 100, which then transfers that displacement to the actuation arms 548 of the spider rotor 516. The amount that the spider rotor 516 is displaced by the actuator directly corresponds with an amount of rotational phasing desired between the cradle rotor 514 and the sprocket hub 510. In one non-limiting example, the actuator may apply an input force in a first direction 566. Displacement of the actuator in the first direction 566 may displace the first input arms 554 into engagement with the first locking members 558, such that the first locking members 558 move out of engagement with the inner surface 564 of the sprocket hub 510 or the first tapered surfaces 536. Thus, in response to the input force in the first direction 566, the first locking members 558 may be biased into an unlocked state.

With the first locking members 558 in the unlocked state, the linear clutch 508 may allow the helix rotor 512 to axially displace in the first direction 566. At the same time, the biasing element 562 may maintain the second locking members 560 in the locked state. Thus, the linear clutch 508 may prevent the helix rotor 512 from axially displacing in a second direction 568 opposite to the first direction 566. For example, the linear clutch 508 may linearly support the helix rotor 512 during cam torque pulses applied to the cradle rotor 514 that attempt to axially displace the helix rotor 512 in the second direction 568. As such, with the input force applied in the first direction 566, the linear clutch 508 may only allow the helix rotor 512 to axially displace in the first direction 566 to achieve the desired rotational relationship between the cradle rotor 514 and the sprocket hub 510.

The helix rotor 512 will be allowed to axially displace in the first direction 566 until the helix rotor 512 displaces in accordance with the amount of displacement applied to the spider rotor 516 by the actuator and again places the first locking members 558 into the wedged, locked state. It should be appreciated that the opposite functionality may be provided by the linear clutch 508 in response to an input force in the second direction 568 applied to the spider rotor 516 by the actuator.

Within this specification embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

Thus, while the invention has been described in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

We claim:

1. A cam phasing system configured to vary a rotational relationship between a camshaft and a crankshaft of an internal combustion engine, the cam phasing system comprising:

a sprocket hub configured to be coupled to the crankshaft;

a cradle rotor configured to be coupled the camshaft;

a spider rotor configured to be coupled to the cradle rotor, wherein the spider rotor is configured to rotate to a predetermined rotational offset relative to the sprocket hub in response to a force applied to the spider rotor; and an actuator coupled to the spider rotor through a compliance mechanism, wherein the actuator is configured to selectively apply the force to the spider rotor through the compliance mechanism, and wherein the compliance mechanism is coupled between the spider rotor and the actuator and includes at least one spring arranged to apply and maintain the force from the actuator on the spider rotor.

2. The cam phasing system of claim 1, wherein the force maintained on the spider rotor by the compliance mechanism is further configured to ensure that the cradle rotor reaches the predetermined rotational offset relative to the sprocket hub.

3. The cam phasing system of claim 1, further comprising an intermediate ring coupled to the spider rotor via the at least one spring.

4. The cam phasing system of claim 3, wherein the actuator is further configured to apply an input displacement so as to rotate the intermediate ring relative to the spider rotor.

5. The cam phasing system of claim 3, wherein the at least one spring includes a coil portion, the coil portion having a first end and a second end.

6. The cam phasing system of claim 5, wherein the spider rotor includes at least one protrusion extending axially from a surface of the spider rotor so as to extend through the coil portion.

7. The cam phasing system of claim 6, wherein the intermediate ring is configured to engage the first end and the second end.

8. The cam phasing system of claim 6, wherein the intermediate ring includes at least one slot within which the first end and the second end are received so as to pre-bias the first end and the second end towards one another.

9. The cam phasing system of claim 8, wherein when the intermediate ring is rotated relative to the spider rotor, the slot engages the first end so as to bias the first end towards the second end.

10. The cam phasing system of claim 9, wherein the biasing applies a corresponding force onto the protrusion via the coil portion of the spring, thereby transferring the force from the intermediate ring to the spider rotor.

11. The cam phasing system of claim 1, wherein the compliance mechanism includes a plurality of compliance mechanisms.

12. A cam phasing system configured to vary a rotational relationship between a camshaft and a crankshaft of an internal combustion engine, the cam phasing system comprising:

a sprocket hub configured to be coupled to the crankshaft;

a cradle rotor configured to be coupled the camshaft;

a spider rotor configured to be coupled to the cradle rotor;

an actuator configured to supply an input displacement;

an intermediate ring coupled to the actuator and configured to receive the input displacement; and a compliance mechanism coupled between the intermediate ring and the spider rotor, wherein the compliance mechanism includes a spring configured to, upon the input displacement being supplied to the intermediate ring, supply and maintain a force on the spider rotor until the spider rotor reaches a predetermined rotational offset relative to the sprocket hub.

13. The cam phasing system of claim 12, wherein the force maintained on the spider rotor by the compliance mechanism is further configured to ensure that the cradle rotor reaches a predetermined rotational offset relative to the sprocket hub.

14. The cam phasing system of claim 12, wherein the spring includes a coil portion, the coil portion having a first end and a second end.

15. The cam phasing system of claim 14, wherein the spider rotor includes at least one protrusion extending axially from a surface of the spider rotor so as to extend through the coil portion.

16. The cam phasing system of claim 12, wherein the spider rotor includes a plurality of protrusions arranged circumferentially around the spider rotor.

17. The cam phasing system of claim 16, wherein the compliance mechanism includes a plurality of compliance mechanisms each including a spring having a first end and a second end extending from a coil portion, and wherein the intermediate ring includes a plurality of slots arranged circumferentially around the intermediate ring such that each compliance mechanism is coupled between a respective protrusion of the plurality of protrusions and a respective slot of the plurality of slots.

18. The cam phasing system of claim 17, wherein when the intermediate ring is rotated relative to the spider rotor, the first end of the spring of each compliance mechanism is engaged by the respective slot so as to be biased toward the second end.

19. The cam phasing system of claim 18, wherein the biasing applies a force onto the respective protrusion via the coil portion of the spring, thereby applying the force from the intermediate ring to the spider rotor.

20. The cam phasing system of claim 12, wherein the compliance mechanism includes a plurality of compliance mechanisms.

* * * * *